US011311926B2

(12) United States Patent
Hioki et al.

(10) Patent No.: US 11,311,926 B2
(45) Date of Patent: Apr. 26, 2022

(54) ELECTROMAGNETIC FORMING METHOD

(71) Applicants: KOBE STEEL, LTD., Kobe (JP); TOYOTA JIDOSHA KABUSHIKI KAISHA, Toyota (JP)

(72) Inventors: Ryusuke Hioki, Kanagawa (JP); Yoshihaya Imamura, Kanagawa (JP)

(73) Assignees: KOBE STEEL, LTD., Kobe (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 64 days.

(21) Appl. No.: 16/977,392

(22) PCT Filed: Feb. 28, 2019

(86) PCT No.: PCT/JP2019/007963
§ 371 (c)(1),
(2) Date: Sep. 1, 2020

(87) PCT Pub. No.: WO2019/168136
PCT Pub. Date: Sep. 6, 2019

(65) Prior Publication Data

US 2021/0170471 A1 Jun. 10, 2021

(30) Foreign Application Priority Data

Mar. 2, 2018 (JP) ..... JP2018-037758

(51) Int. Cl.
*B21D 26/14* (2006.01)
*B21D 39/06* (2006.01)
*B21D 39/08* (2006.01)

(52) U.S. Cl.
CPC ..... *B21D 26/14* (2013.01); *B21D 39/06* (2013.01); *B21D 39/08* (2013.01)

(58) Field of Classification Search
CPC ..... B21D 26/00; B21D 26/14; B21D 26/031; B21D 26/033; B21D 26/047; B21D 39/08; B21D 39/06
See application file for complete search history.

(56) References Cited

U.S. PATENT DOCUMENTS 3,911,706 A * 10/1975 Davis ..... B21D 26/14 72/56

FOREIGN PATENT DOCUMENTS

| | | | |
|---|---|---|---|
| CN | 107413916 | A | 12/2017 |
| JP | 2004-351455 | A | 12/2004 |
| JP | 2017-131959 | A | 8/2017 |

OTHER PUBLICATIONS

International Search Report dated May 28, 2019 in PCT/JP2019/007963 filed on Feb. 28, 2019, 1 page.

* cited by examiner

*Primary Examiner* — Teresa M Ekiert
(74) *Attorney, Agent, or Firm* — Oblon, McClelland, Maier & Neustadt, L.L.P.

(57) ABSTRACT

An electromagnetic forming method includes: a step of setting pipe periphery members at plural positions along an axial direction of a pipe material; a step of setting a coil unit on a side of one end, in the axial direction, of the pipe material, the coil unit including a conductor wound portion, conductor extension portions, and a resin-made conductor support portion; a step of setting a support member on a side of the other end, in the axial direction, of the pipe material; a coil unit holding step; a coil setting step; and a swaging step. The coil setting step and the swaging step are performed in this order at each of the plural positions of the pipe material while the coil unit is kept held by the support member.

20 Claims, 27 Drawing Sheets

ELECTROMAGNETIC FORMING METHOD

TECHNICAL FIELD

The present invention relates to an electromagnetic forming method for swaging a pipe material onto pipe periphery members disposed outside the outer circumferential surface of the pipe material by expanding the pipe material by electromagnetic formation.

BACKGROUND ART

Many steel members are used in automobiles from the viewpoints of mechanical strength, cost, welding workability, etc. To meet the recent requirement of increase in fuel efficiency, some steel members have been replaced by lighter members and it has been studied to apply such lighter members to not only panel members but also frame members. Although frame members are typically manufactured by various manufacturing methods such as pressing, welding, and casting, they can also be manufactured through application of electromagnetic formation. For example, a method of disposing plural pipe periphery members such as brackets outside the outer circumferential surface of a long pipe material and fixing the pipe material onto the pipe periphery members through swaging by expanding the pipe material by electromagnetic formation is suggested (Patent Literature 1).

In electromagnetic formation, a target material to be subjected to formation is set in the vicinity of an inductor (coil) and energy charged in a capacitor is applied to the coil in the form of a large pulse current in a very short time of several milliseconds or less. As a result, an induction current flows through the target material to generate Lorentz force, thereby expanding the target material. Such fixing by swaging using electromagnetic formation causes no thermal strain. Therefore, a structural body can be produced with high accuracy, as compared with a welding method

CITATION LIST

Patent Literature

Patent Literature 1: JP-A-2017-131959

SUMMARY OF INVENTION

Technical Problems

Incidentally, examples of frame members of an automobile include a reinforcement member such as an instrument panel reinforcement member. Typically, the instrument panel reinforcement member has relatively long axial length and is provided with pipe periphery members such as brackets for attachment of members at plural positions in its longitudinal direction.

In manufacturing such a component by electromagnetic formation, a coil unit having a forming coil is inserted into a pipe material and the forming coil is set at an axial position inside the pipe material where a bracket is disposed. In this state, a pulse current is applied to the forming coil. At this time, since the pipe material is long, off-centering tends to occur between the pipe material and the coil unit inserted in the pipe material and hence a variation is prone to occur in the swaging state of the expanded pipe material in its circumferential direction.

Furthermore, the arrangement relationship between a pipe material and a pipe periphery member also influences a swaging result.

Each of FIG. 23A and FIG. 23B is a sectional view of essential parts of respective members in the case where a forming coil 213 is set so as to face the inner circumferential surface 211*a* of a pipe material 211, a pipe periphery member 215 is set so as to face the outer circumferential surface 211*b* of the pipe material 211, and the pipe material 211 is expanded by electromagnetic formation.

As shown in FIG. 23A, in the case where the surface 215*a*, which faces the pipe material 211, of the pipe periphery member 215 is inclined from the axial direction of the pipe material 211 (tapered) by an angle θ, when the pipe material 211 is expanded by electromagnetic formation, first, as shown in FIG. 24A, the pipe material 211 touches a minimum diameter portion 215*b* of the inner circumferential surface of the pipe periphery member 215. Then eddy current induced in the pipe material 211 flows to the side of the pipe periphery member 215 via the minimum diameter portion 215*b* and the electromagnetic force acting on the pipe material 211 is weakened. As a result, as shown in FIG. 24B, a difference occurs between expansion forces acting on the pipe material 211 at the two respective end portions, in the axial direction, of the pipe periphery member 215. Then, the swaging may become weaker in a region 217 opposite to the minimum diameter portion 215*b* in the axial direction. In addition, in the case of a pipe periphery member 219 shown in FIG. 23B in which a minimum diameter portion 219*b* exists at the center, in the axial direction, of a confronting surface 219*a* and portions located on the two respective sides of the minimum diameter portion 219*b* in the axial direction are tapered, the swaging of the pipe material 211 likewise tends to become weaker at two end portions, in the axial direction, of the pipe periphery member 219. As described above, in the case where a long pipe material is subjected to electromagnetic formation, the location of the forming coil inserted in the pipe material and the shape of the surface, facing the pipe material, of a pipe periphery member influence a swaging result.

In view of the above, an object of the present invention is to provide an electromagnetic forming method capable of swaging a long pipe material to a pipe periphery member so as to perform a uniform swaging by positioning a forming coil accurately by preventing an off-centering of the pipe material and a coil unit.

Solution to Problem

The present invention includes the following configurations.

(1) An electromagnetic forming method, including:

a step of setting pipe periphery members at plural positions along an axial direction of a pipe material;

a step of setting a coil unit on a side of one end, in the axial direction, of the pipe material, the coil unit including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a step of setting a support member on a side of the other end, in the axial direction, of the pipe material, in which at least a tip of the support member on a side of the pipe material is made of an insulator;

a coil unit holding step of causing the coil unit and the support member to butt against each other by relatively moving the coil unit and the support member to each other in the axial direction of the pipe material, thereby causing the tip portion of the support member to hold the coil unit coaxially;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit, in which the coil setting step and the swaging step are performed in this order at each of the plural positions of the pipe material while the coil unit is kept held by the support member.

(2) An electromagnetic forming method, including:

a step of setting pipe periphery members at plural positions along an axial direction of a pipe material;

a step of setting a pair of coil units on a side of one end and a side of the other end, in the axial direction, of the pipe material, each of the coil units including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a coil unit holding step of causing the pair of coil units to butt against each other by relatively moving the coil units to each other in the axial direction of the pipe material, thereby causing a tip portion of a support member to hold a tip portion of the coil unit which faces the support member coaxially, the support member being provided at an insertion-side tip of at least one of the coil units and at least two end portions of the support member in the axial direction being made of an insulator;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit set at an axial position of the pipe periphery member, in which the coil setting step and the swaging step are performed in this order at each of the plural positions of the pipe material while the coil unit is kept held by the support member.

Advantageous Effects of Invention

In the present invention, an off-centering of a pipe material and a coil unit can be prevented and a forming coil can be accurately positioned. As a result, a long pipe material can be swaged to a pipe periphery member so as to perform uniform swaging.

DESCRIPTION OF EMBODIMENTS

Embodiments of the present invention will be hereinafter described in detail with reference to the drawings. The embodiments described below will be directed to an example in which brackets for attachment of members are attached to an instrument panel reinforcement member having a long axial length by electromagnetic formation. However, the present invention is not limited to the case and can also be applied to cases where rigid bodies such as pipe periphery members are attached to a pipe material for any of other uses and any other kinds of a pipe material.

<Configuration of Formed Body>

Figure 1:
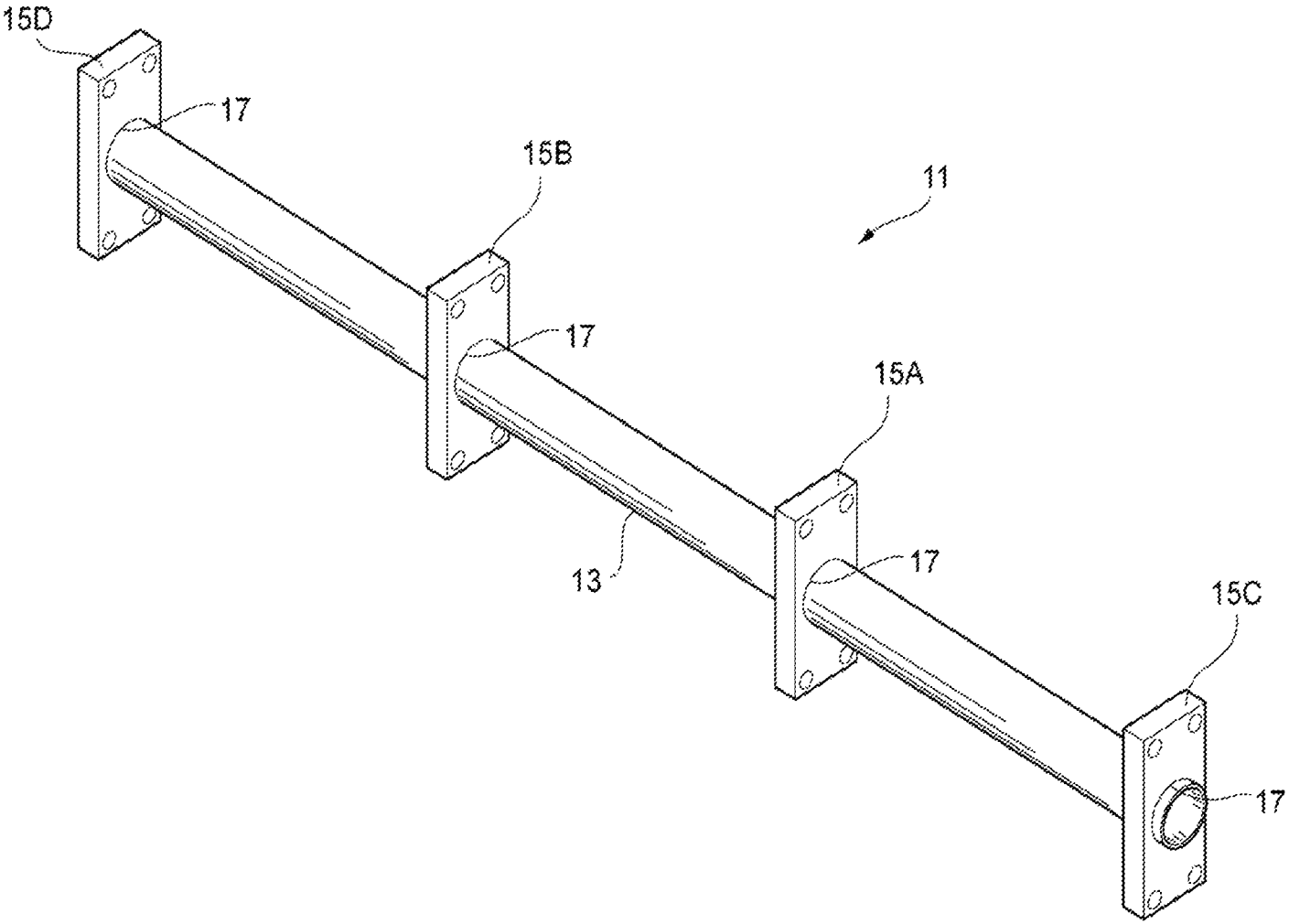
FIG. 1 is a perspective view schematically showing an appearance of a formed body produced by electromagnetic formation.

FIG. 1 is a perspective view schematically showing an appearance of a formed body produced by electromagnetic formation.

A formed body 11 has an aluminum pipe material (hereinafter abbreviated as a "pipe material") 13, brackets 15A and 15B provided on the outer circumferential surfaces of intermediate portions, in the axial direction, of the pipe material 13, and brackets 15C and 15D provided on the outer circumferential surfaces of two respective end portions of the pipe material 13. Each of the brackets 15A, 15B, 15C, and 15D (pipe periphery members) has a circular through-hole 17 and is fixed to the pipe material 13 having a circular cross section in a state where the pipe material 13 is inserted through each of the through-hole 17.

The pipe material 13 can be manufactured by extrusion molding or welding of a plate material, and is not limited to a circular pipe (the example shown). The pipe material 13 may be a tetragonal pipe having a square or rectangular cross section, a hexagonal pipe having a hexagonal cross section, or an octagonal pipe having an octagonal cross section. Preferable examples of the material of the pipe material 13 include an aluminum alloy (JIS 6000 series, JIS 7000 series, etc.). For example, a hollow pipe made of an aluminum alloy A6063 for extrusion can be used as the pipe material 13.

The brackets 15A, 15B, 15C, and 15D (hereinafter also referred to together as "brackets 15") are rigid members configured to be integrated with the pipe material 13 in the formation. The brackets 15 are metal members made of steel of, for example, the JIS standard SS400, an aluminum extrusion material (e.g., 6063T5 (JIS H 4100)), an aluminum casting (e.g., AC4CH AI (JIS H 5202)), or the like, and can be made of a resin injection-molded material in some use conditions of the formed body 11. The through-holes 17 of the brackets 15 are preferably similar to the sectional shape of the pipe material 13. For example, the through-holes 17 are preferably circular in the case where the pipe material 13 is a circular pipe. The through-holes 17 are formed so as to have an inner diameter that is slightly larger than the outer diameter of the pipe material 13 before expansion by electromagnetic formation.

<Configuration of Electromagnetic Forming Machine>

Next, the configuration of an electromagnetic forming machine 100 for manufacturing a formed body 11 by swaging the pipe material 13 onto the brackets 15 by electromagnetic formation will be described.

Figure 2:
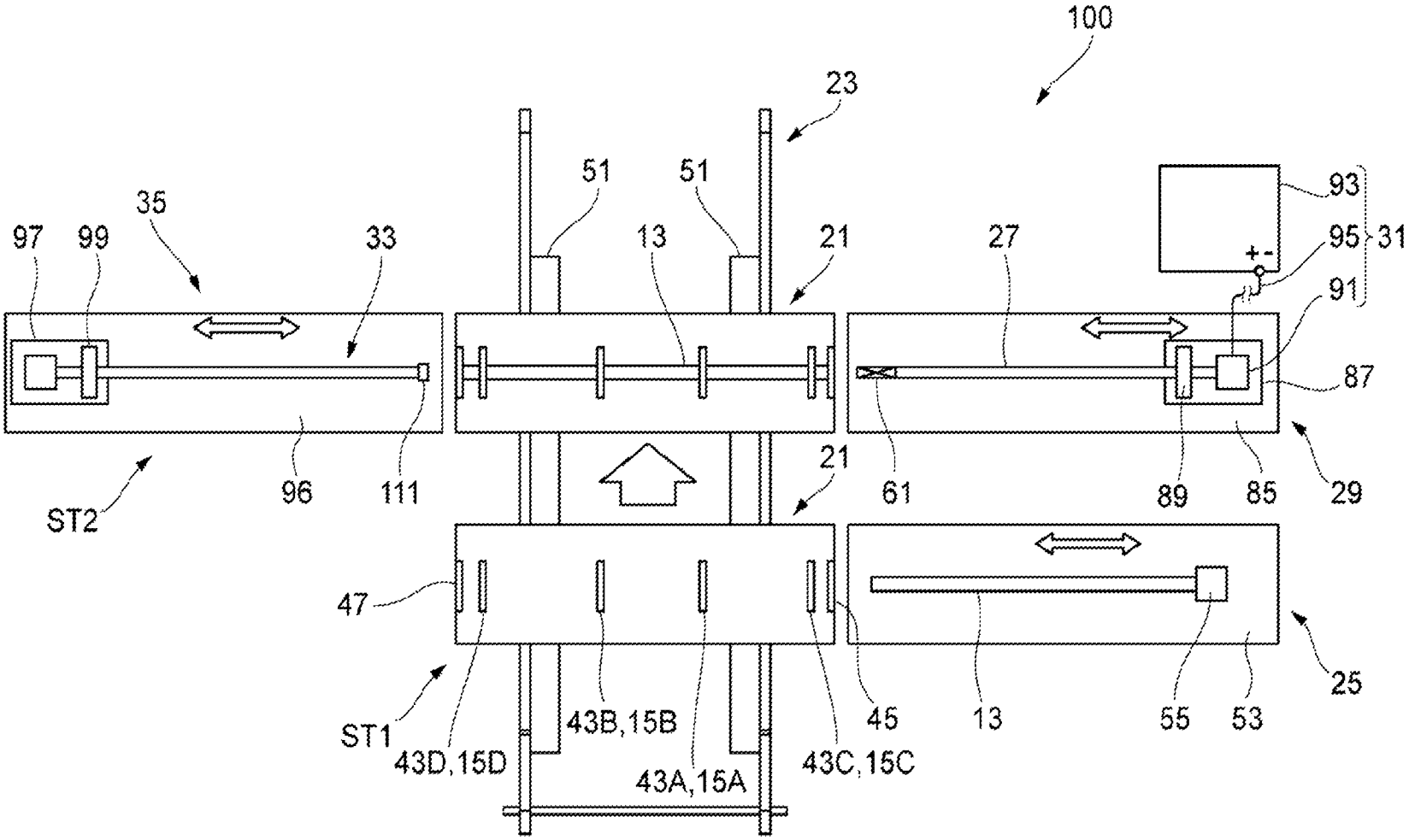
FIG. 2 is a schematic plan view of an electromagnetic forming machine.

FIG. 2 is a schematic plan view of the electromagnetic forming machine 100.

The electromagnetic forming machine 100 is equipped with plural jig plates 21, a jig plate conveying mechanism 23, a pipe material insertion mechanism 25, an electromagnetic formation coil unit 27, a coil moving mechanism 29, a current supply unit 31, a support rod (support member) 33, and a support rod moving mechanism 35 for moving the support rod 33 in the axial direction.

The electromagnetic forming machine 100 includes a pipe insertion stage ST1 and a pipe expansion stage ST2, and operates roughly in the following manner. In the pipe insertion stage ST1, the pipe material 13 is transferred to a jig plate 21 by the pipe material insertion mechanism 25. The jig plate conveying mechanism 23 conveys, to the pipe expansion stage ST2, a jig plate 21 to which the pipe material 13 has been transferred.

In the pipe expansion stage ST2, the coil unit 27 is inserted by the coil moving mechanism 29 into the pipe material 13 supported by the jig plate 21. Furthermore, the support rod 33 is inserted by the support rod moving mechanism 35 into the pipe material 13 supported by the jig plate 21. Then the coil unit 27 is energized by the current supply unit 31, thereby expanding the pipe material 13 by electromagnetic formation. A formed body 11 as described above is thus manufactured.

Next, the individual units of the above-described electromagnetic forming machine 100 will be described in detail in order.

<Jig Plate>

Figure 3:
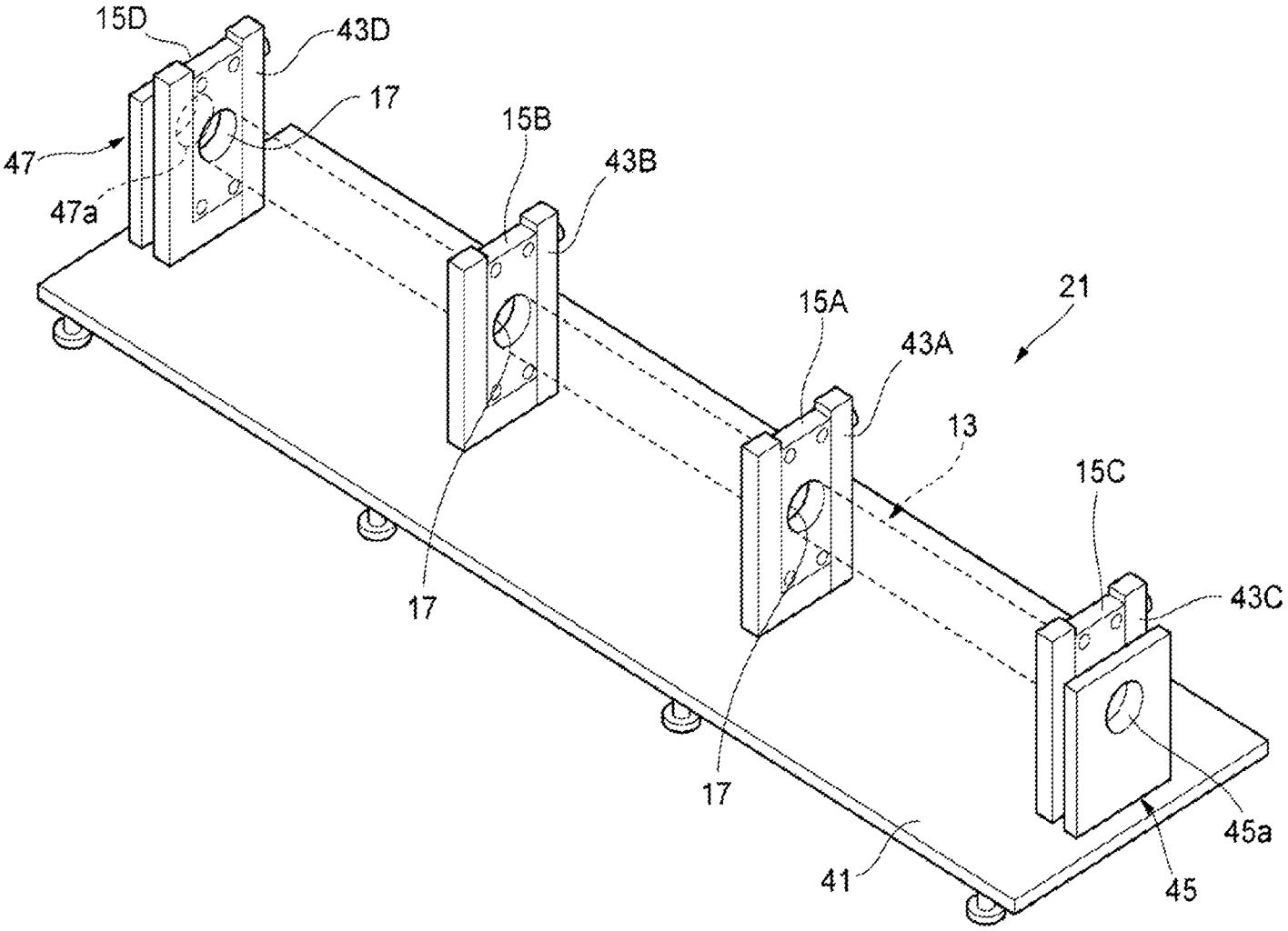
FIG. 3 is a perspective view of a jig plate.

FIG. 3 is a perspective view of a jig plate 21.

The jig plate 21 is equipped with a substrate 41, bracket holders 43A, 43B, 43C, and 43D fixed to the substrate 41, and pipe material positioning members 45 and 47 respectively disposed outside the bracket holders 43C and 43D in the axial direction. The brackets 15A, 15B, 15C, and 15D to be supported by the bracket holders 43A, 43B, 43C and 43D, and the pipe material 13 (drawn by broken lines in the figure) to be inserted in the through-holes 17 of the respective brackets 15A, 15B, 15C, and 15D are also shown in FIG. 3.

The top surface of the substrate 41, which is a single steel material, is formed with an electrically insulating layer made of a phenol resin (Bakelite (registered trademark)) or the like. Since the substrate 41 has so high stiffness that a warp is prevented, the substrate 41 can hold, with a small bend, a long member having a long axial length as compared with the diameter such as the pipe material 13. Furthermore, the presence of the electrically insulating layer prevents induction current induced in the pipe material 13 from flowing into the substrate 41.

The bracket holder 43A receives the bracket 15A, and they are fastened by, for example, a toggle clamp (not shown). In this manner, the bracket 15A is held in a state that the through-hole 17 is positioned at a predetermined position. Likewise, the bracket holders 43B, 43C, and 43D position and hold the respective brackets 15B, 15C, and 15D. Thus, all of the through-holes 17 of the brackets 15A, 15B, 15C, and 15D held by the respective bracket holders 43A, 43B, 43C, and 43D are disposed so as to have the common axis.

The pipe material positioning members 45 and 47 support the end portions of the pipe material 13 inserted in the through-holes 17 and position the pipe material 13 so that its center axis coincides with the center axes of the respective through-holes 17. Thus, a radial gap that is uniform in the circumferential direction is formed between the outer circumferential surface of the pipe material 13 and the inner circumferential surface of the through-hole 17 of each bracket.

Although there are no particular limitations on the positioning mechanism of each of the pipe material positioning members 45 and 47, it may be a chuck mechanism capable of moving and adjusting the end portion of the pipe material 13 in the horizontal and vertical directions. As another example, as shown in FIG. 3, each of the pipe material positioning members 45 and 47 may be a plate member through which a guide hole 45*a* or 47*a* whose diameter is approximately the same as the outer diameter of the pipe material 13 is formed such that its center axis coincides with the center axis of the through-holes 17. In either case, an adjustment can be made so that the outer circumferential surface of the pipe material 13 is made parallel with the inner circumferential surfaces of the through-holes 17 in a cross section taken along the axial direction of the pipe material 13, preferably with an inclination of less than 3°, more preferably with an inclination of less than 1°. As long as the above two kinds of surfaces are within the above inclination range, the pipe material 13 can be swaged satisfactorily so as to be in close contact with the inner circumferential surfaces of the through-holes 17.

<Jig Plate Conveying Mechanism>

The jig plate conveying mechanism 23 shown in FIG. 2 includes a pair of conveying rails 51 and a conveyor (not shown) which is disposed along the conveying rails 51 and in which a conveyor chain circulates. The jig plates 21 are mounted on the conveyor and conveyed by the conveying rails 51 by driving the conveyor chain. That is, the jig plate conveying mechanism 23 conveys each jig plate 21 along the conveying rails 51 from the pipe insertion stage ST1 to the pipe expansion stage ST2.

<Pipe Insertion Mechanism>

The pipe material insertion mechanism 25 in the pipe insertion stage ST1 shown in FIG. 2 includes a base 53 disposed on the side of one end (on the right side in FIG. 2) of the jig plate 21 and a pipe insertion driving unit 55 provided on the base 53.

The pipe insertion driving unit 55 that supports one end portion of the pipe material 13 by means of a chuck mechanism (not shown) moves the pipe material 13 toward the jig plate 21 in the direction of its pipe axis. As a result, the pipe material 13 is inserted into the through-holes 17 (see FIG. 3) of the brackets 15A, 15B, 15C, and 15D held by the respective bracket holders 43A, 43B, 43C, and 43D.

The jig plate 21 of the jig plate conveying mechanism 23 and the base 53 are arranged such that their top surfaces are parallel with each other. Thus, when the pipe material 13 is moved by the pipe insertion driving unit 55, the pipe material 13 is inserted into the through-holes 17 of the brackets 15A, 15B, 15C, and 15D supported by the jig plate 21 side while being kept coaxial with the through-holes 17. Further, the pipe material 13 is guided by the through-holes 17 and positioned by the pipe material positioning members 45 and 47 so as to be coaxial with the through-holes 17. As a result, the pipe material 13 is set so as to be coaxial with the through-holes 17 with high accuracy.

<Coil Unit>

The coil unit 27 is set on one side (right side in FIG. 2) of the jig plate 21 in the pipe expansion stage ST2. The coil unit 27 includes a coil portion 61 at its tip located on the side of the pipe expansion stage ST2.

Figure 4:
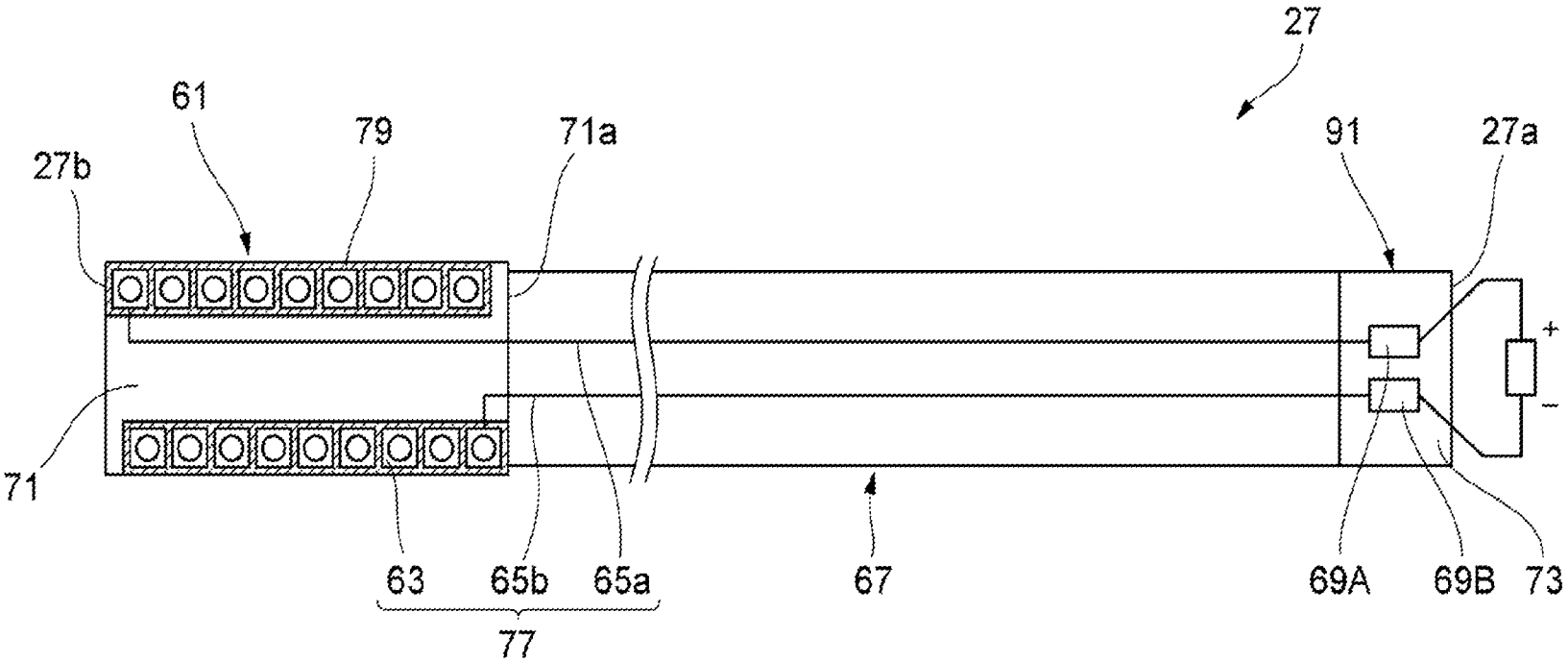
FIG. 4 is a schematic configuration view of a coil unit.

FIG. 4 is a schematic configuration view of the coil unit 27.

The coil unit 27 is formed so as to extend in the longitudinal direction from a base end 27*a* to a tip 27*b*, and is to be inserted into the pipe material 13 such that the tip 27*b* is inserted first (see FIG. 3).

The coil unit 27 includes a conductor wound portion 63, a pair of conductor extension portions 65*a* and 65*b*, end portions on one side of which are connected to the conductor wound portion 63 and which extend in the longitudinal direction, a resin conductor support portion 67 which is provided so as to extend in the longitudinal direction of the coil unit 27 and which supports at least the conductor extension portions 65*a* and 65*b*, and coil terminal portions 69A and 69B which are connected to end portions on the other side (base side) of the conductor support portion 67.

The conductor wound portion 63 is disposed in a peripheral portion of a cylindrical resin core member 71. The coil terminal portions 69A and 69B are disposed in a terminal support portion 73 which is provided on the base side of the conductor support portion 67. The core member 71 may be formed either separately (i.e., so as to be separable) from the conductor support portion 67 or integrated with the conductor support portion 67.

Figure 5:
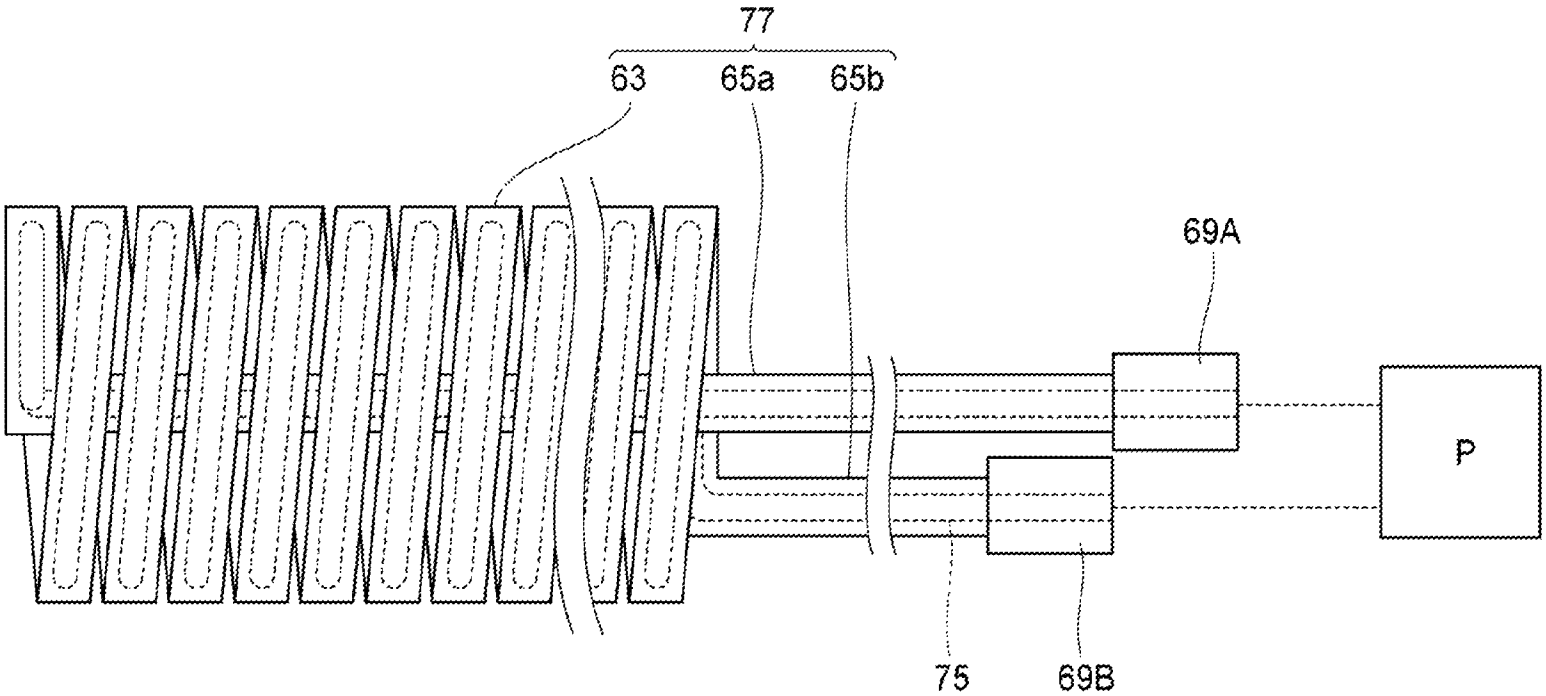
FIG. 5 is a schematic view for showing a sole configuration of a conductor used in the coil unit.

FIG. 5 is a schematic view for showing the sole configuration of a conductor used in the coil unit 27.

The conductor wound portion 63 and the conductor extension portions 65*a* and 65*b* include a tubular conductor (hollow conductor) 77 having a central communication hole 75. The communication hole 75 is also formed through the coil terminal portions 69A and 69B. A pump P is connected to the communication hole 75 and a cooling medium is supplied from the pump P to the communication hole 75. The cooling medium cools the conductor wound portion 63 and the conductor extension portions 65A and 65B which generate heat during energization. Examples of the cooling medium include air, a nitrogen gas, an argon gas, and a helium gas.

An electrically insulating resin coating layer 79 covering the conductor 77 is provided on the outer circumferential surface of the conductor wound portion 63 shown in FIG. 4. The resin coating layer 79 is formed by winding a glass fiber tape around the surface of the conductor 77, then winding the resulting structure on the outer circumferential surface of the core member 71, and impregnating the tape wound around the conductor 77 with a resin. The resin coating layer 79 is provided not only on the outer circumferential surface of the conductor wound portion 63 but also between adjacent conductors of the conductor wound portion 63 and on the inner circumferential surface of the conductor wound portion 63. The outer circumferential surface of the resin coating layer 79 is finished into a smooth surface, by cutting, grinding, and polishing if necessary.

Figure 6:
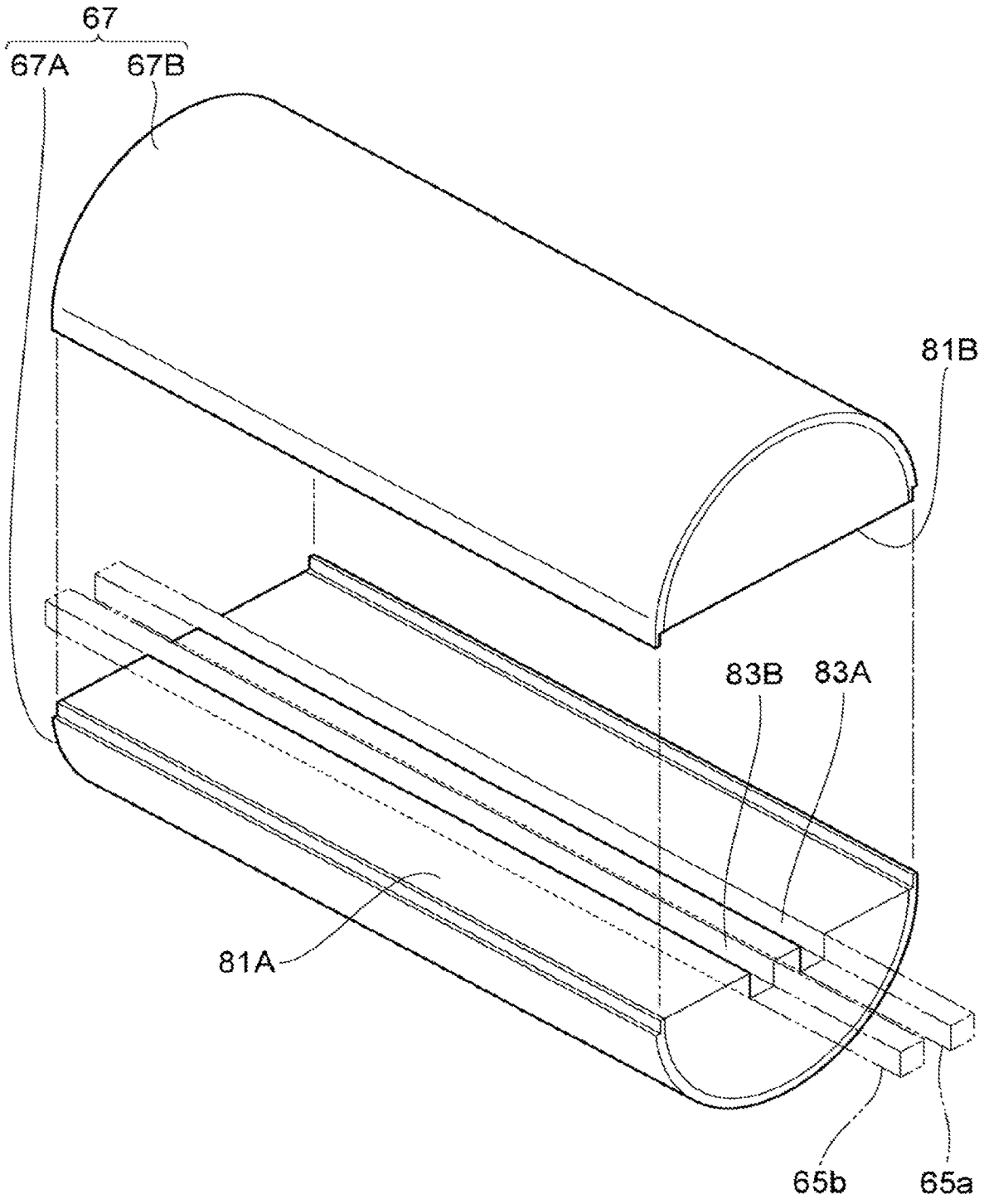
FIG. 6 is an exploded perspective view of a part of the conductor support portion.

FIG. 6 is an exploded perspective view of a part of the conductor support portion 67.

The conductor support portion 67 is provided so as to extend from the core member 71 to the terminal support portion 73 located on the side of the base end 27*a*, the members being shown in FIG. 4. The conductor support portion 67 shown in FIG. 6 is a cylindrical member formed separately from the core member 71 and includes a pair of divisional pieces 67A and 67B which are semicircular in a cross section taken perpendicularly to the axial direction.

A division confronting surface (denoted by symbol 81A in the example shown in FIG. 6) of at least one of the pair of divisional pieces 67A and 67B is formed to have, along the longitudinal direction of the conductor support portion 67, a pair of conductor holding portions 83A and 83B, which is respectively configured to hold the pair of conductor extension portions 65*a* and 65*b* so that they are spaced from each other by a predetermined interval. The conductor holding portions 83A and 83B receive the conductor extension portions 65*a* and 65*b* in their grooves, respectively, thereby protecting the conductor extension portions 65*a* and 65*b* from vibration to occur in the pair of conductor extension portions 65*a* and 65*b* through which currents flow in opposite directions.

<Coil Moving Mechanism>

Next, the coil moving mechanism 29 will be described.

The coil moving mechanism 29 in the pipe expansion stage ST2 shown in FIG. 2 includes a base 85 disposed on one side (on the right side in FIG. 2) of the jig plate 21 and a coil moving unit 87 which is provided on the base 85 and supports a base end portion of the coil unit 27.

The coil moving unit 87 includes a chucking unit 89 for gripping the coil unit 27 and a driving unit (not shown) configured to move the coil unit 27 in the longitudinal direction. The driving unit drives the coil unit 27 in such a manner that the coil unit 27 can advance and retreat in the longitudinal direction.

The coil moving mechanism 29 supports the coil unit 27 such that the coil unit 27 can be inserted into and removed from the pipe material 13 while the coil unit 27 has the same axis with the pipe material 13. The coil portion 61 can be set at a desired expansion position by moving the coil unit 27 by means of the coil moving mechanism 29.

<Current Supply Unit>

The current supply unit 31 is configured to supply a current for electromagnetic formation to the coil portion 61 shown in FIG. 2. The current supply unit 31 includes a terminal connection portion 91 for connection to the coil terminal portions 69A and 69B (see FIG. 4) of the coil unit 27, a power source unit 93, and a high-voltage power cable 95 to connect the power source unit 93 to the coil terminal portions 69A and 69B.

The power source unit 93 is configured to output, in the form of a large pulse current, energy charged in a capacitor via a switch in a very short time of several milliseconds or less. The output pulse current is supplied to the coil portion 61 via the high-voltage power cable 95. Energy that is input per one electromagnetic forming operation is about 20 kJ, for example.

Examples of the above-mentioned switch include a gap switch, a thyratron switch, a mechanical switch, a semiconductor switch, and an ignitron switch.

<Support Rod Moving Mechanism>

The support rod moving mechanism 35 is disposed on the side (left side in FIG. 2) of the other end, opposite to the side of the one end where the coil moving mechanism 29 is disposed, of the jig plate 21 in the pipe expansion stage ST2. The support rod moving mechanism 35 includes a base 96 and a support rod moving unit 97 which is provided on the base 96 and supports the support rod 33 such that the support rod 33 can be desirably moved in the longitudinal direction.

The support rod moving unit 97 includes a chucking unit 99 which supports a base end portion of the support rod 33 and a driving unit (not shown) for moving the support rod 33 supported by the chucking unit 99 in the longitudinal direction. The driving unit drives the support rod 33 such that the support rod 33 can advance and retreat along the longitudinal direction.

Figure 7:
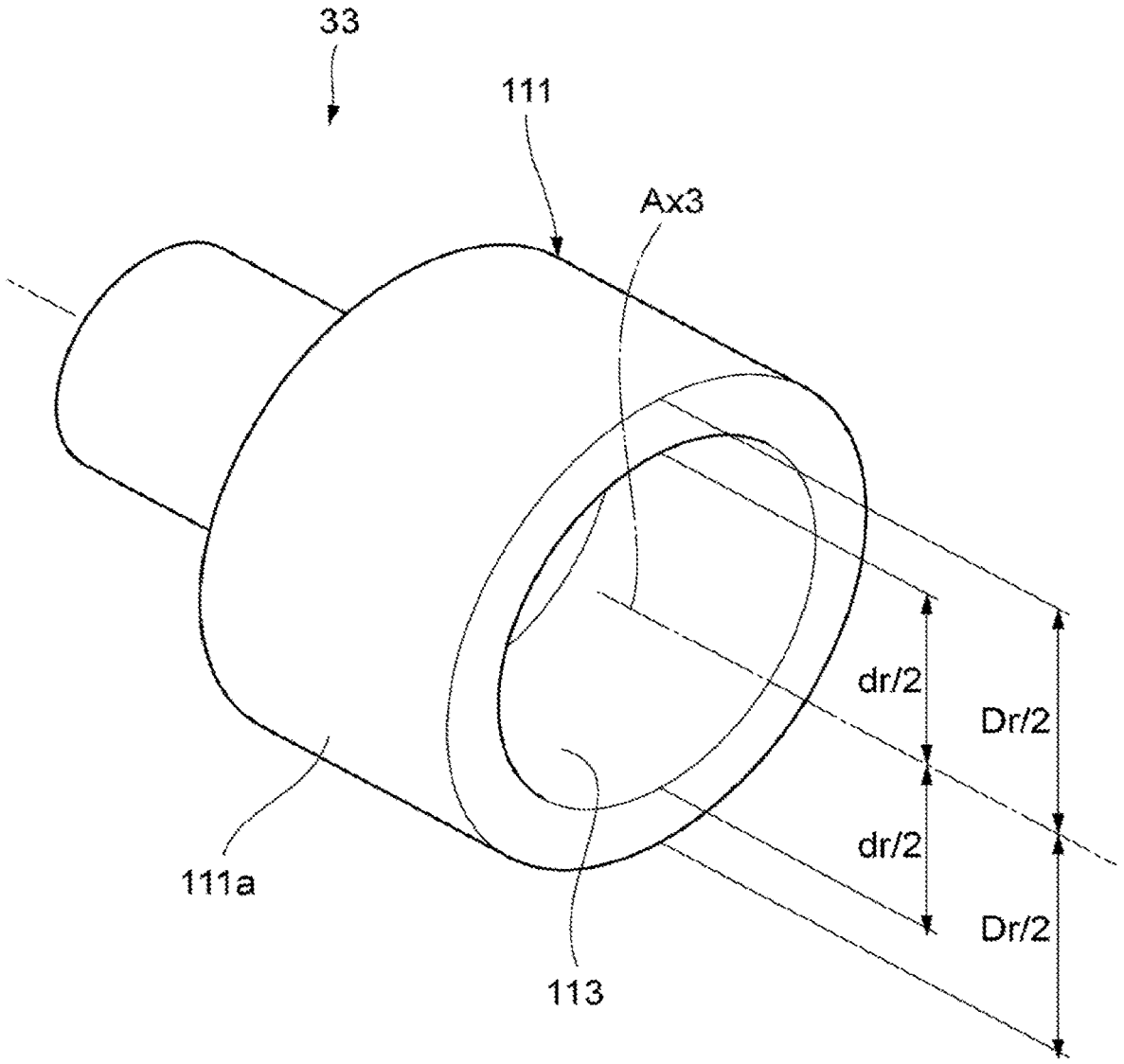
FIG. 7 is an enlarged perspective view of a coil holding portion which is provided at the tip of a support rod.

FIG. 7 is an enlarged perspective view of a coil holding portion 111 which is provided at the tip of the support rod 33.

The coil holding portion 111 is provided at the tip, located on the side of the jig plate 21 (see FIG. 2), of the support rod 33. The coil holding portion 111 is electrically insulating (an insulator) and is shaped like a bottom-closed cylinder. A cylindrical outer circumferential surface 111*a* of the coil holding portion 111 has an outer diameter Or being the same as or slightly smaller than the inner diameter of the pipe material 13. The coil holding portion 111 is formed to have, in its tip portion, an engagement recess 113 which is circular in a cross section taken perpendicularly to the axial direction.

The engagement recess 113 has an inner diameter ϕdr being approximately equal to the outer diameter of the coil portion 61 of the coil unit 27 and is formed so as to be coaxial with the support rod 33. The structure of the coil holding portion 111 is not limited to the one shown in FIG. 7. The coil holding portion 111 may be in any form as long as it is configured so as to be able to hold the coil portion 61 of the coil unit 27 inside the pipe material 13.

Other configurations other than the case where the entire coil holding portion 111 is an insulator can be used as long as at least the end surface, on the side where the engagement recess 113 is formed, of the coil holding portion 111 and the inner surfaces of its engagement recess 113 are electrically insulating.

<First Electromagnetic Forming Method>

Next, a procedure of forming a pipe material 13 shown in FIG. 1 by electromagnetic formation with the electromagnetic forming machine 100 having the above configuration will be described in order.

Figure 8:
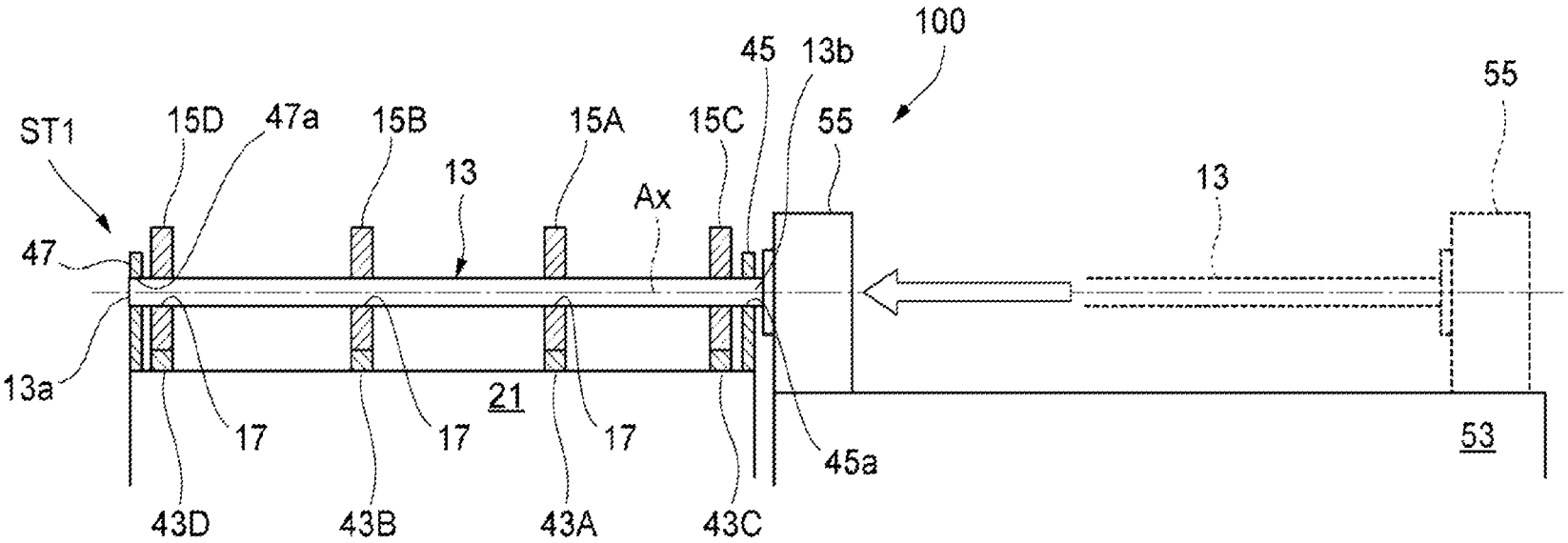
FIG. 8 is a process explanation view for illustrating a pipe insertion process of inserting a pipe material into through-holes of brackets held on a jig plate in a pipe insertion stage.

FIG. 8 is a process explanation view for showing a pipe insertion step of inserting a pipe material 13 into the through-holes 17 of brackets 15A, 15B, 15C, and 15D being held on a jig plate 21 in the pipe insertion stage ST1.

First, a pipe material 13 is prepared and attached to the chuck mechanism of the pipe insertion driving unit 55 of the pipe material insertion mechanism 25 shown in FIG. 2.

Further, brackets 15A, 15B, 15C, and 15D are attached to the respective bracket holders 43A, 43B, 43C, and 43D of the jig plate 21. The brackets 15A, 15B, 15C, and 15D are fixed to the respective bracket holders 43A, 43B, 43C, and 43D such that the through-holes 17 have a common axis. In this manner, the pipe material 13 supported by the pipe insertion driving unit 55, the through-holes 17 of the brackets 15A, 15B, 15C, and 15D, and the guide holes 45*a* and 47*a* of the pipe material positioning members 45 and 47 are arranged coaxially so as to share the axial line Ax as the center axis.

(Pipe Insertion Step)

Next, the pipe material 13 is moved toward the jig plate 21 by driving of the pipe insertion driving unit 55. As a result, one pipe end portion 13*a* of the pipe material 13 is inserted into the guide hole 45*a* of the pipe material positioning member 45, the through-holes 17 of the brackets 15C, 15A, 15B, and 15D, and the guide hole 47*a* of the pipe material positioning member 47, in this order. The one pipe end portion 13*a* located on the insertion tip side comes to be supported by the guide hole 47*a* of the pipe material positioning member 47 and the other pipe end portion 13*b* located on the insertion tail side comes to be supported by the guide hole 45*a* of the pipe material positioning member 45.

In this manner, the pipe material 13 is positioned with respect to the brackets 15A, 15B, 15C, and 15D in a coaxial state in high accuracy such that they share the axial line Ax as the center axis. After transferring the pipe material 13 to the jig plate 21, the pipe insertion driving unit 55 retreats to a retreat position (indicated by a broken line in FIG. 8).

The jig plate conveying mechanism 23 shown in FIG. 2 conveys the jig plate 21 on which the above-described pipe material 13 has been supported in the pipe insertion stage ST1, to the pipe expansion stage ST2.

(Setting Step for Coil Unit and Support Member)

Figure 9A:
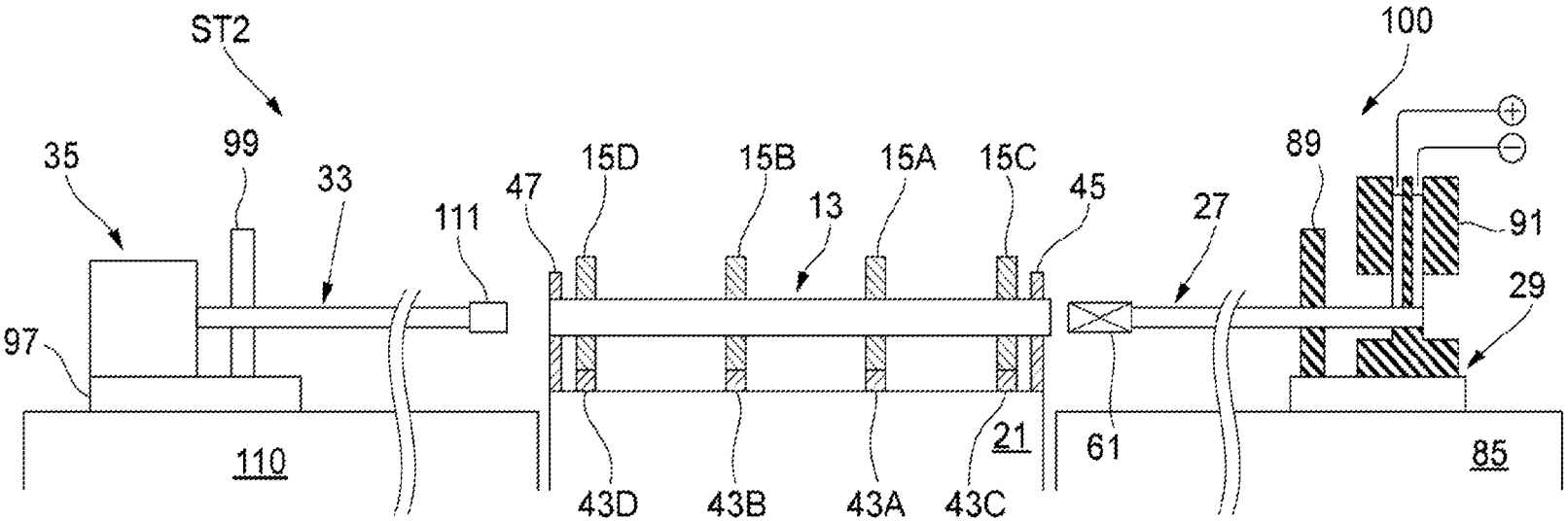
FIG. 9A is a process explanation view for illustrating, step by step, an expansion process of inserting the coil unit and the support rod into the pipe material supported on the jig plate and expanding the pipe material.
Figure 9B:
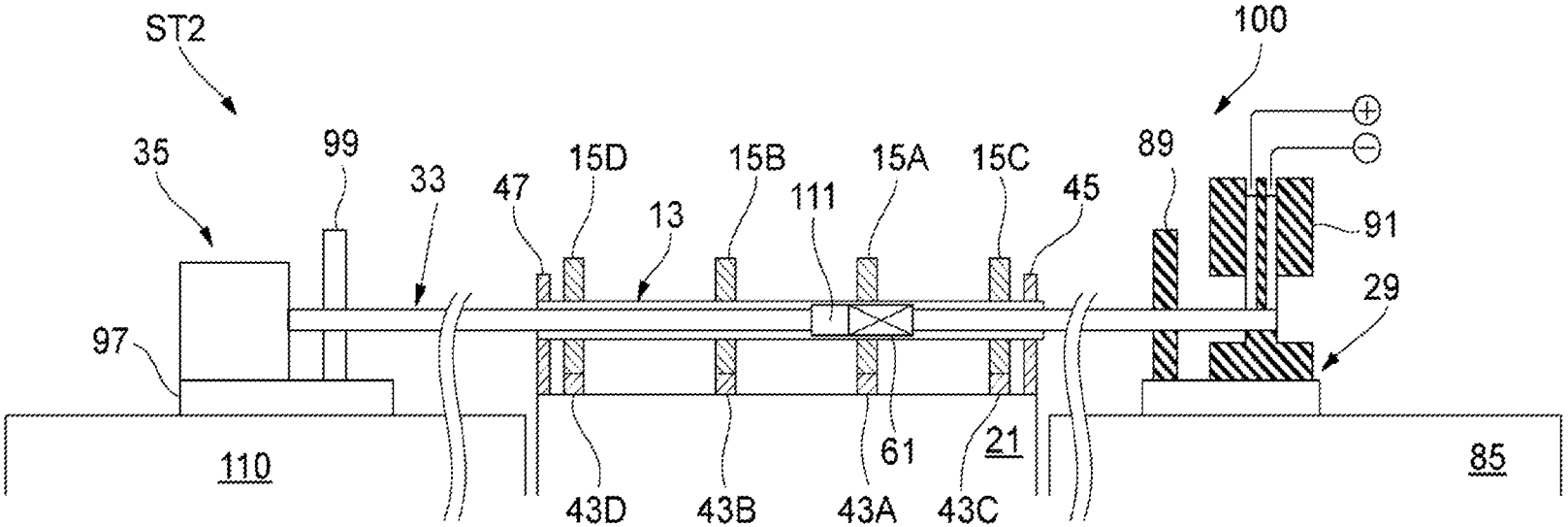
FIG. 9B is another process explanation view for illustrating, step by step, the expansion process of inserting the coil unit and the support rod into the pipe material supported on the jig plate and expanding the pipe material.

FIG. 9A and FIG. 9B are process explanation views for illustrating, step by step, an expansion process for inserting the coil unit 27 and the support rod 33 into the pipe material 13 being supported on the jig plate 21 and expanding the pipe material 13.

As shown in FIG. 9A, on the jig plate 21 having been conveyed to the pipe expansion stage ST2, the coil unit 27 supported by the coil moving mechanism 29 and the support rod 33 supported by the support rod moving mechanism 35 are disposed so as to face each other in the center axis of the pipe material 13 such that their end portions face each other with the pipe material 13 interposed therebetween.

(Coil Moving Step)

Then, as shown in FIG. 9B, the coil moving mechanism 29 moves the coil unit 27 toward the jig plate 21 and sets the coil portion 61 inside the pipe material 13 (inside the pipe material inner circumferential surface) at a position where the coil portion 61 overlaps with the bracket 15A. When the coil unit 27 is inserted into the pipe material 13, from the viewpoints of the ease of insertion of the coil and uniformity of electromagnetic formation, the coil unit 27 is preferably coaxial with the pipe material 13. Although an example in which electromagnetic formation is performed at the axial position of the bracket 15A will be described below, the order of execution of electromagnetic formation at the axial positions of the respective brackets 15A, 15B, 15C, and 15D can be set in a desired manner.

(Coil Unit Holding Step)

Then the support rod 33 is moved toward the jig plate 21 by driving the support rod moving unit 97 such that the coil holding portion 111 is butted against the coil portion 61. In this manner, an insertion-side tip portion of the coil portion 61 is held by the coil holding portion 111 and the coil portion 61 is supported stably inside the pipe material 13. The coil moving mechanism 29 restricts movement of the coil unit 27 in the axial direction with the coil portion 61 located at the position where the coil portion 61 is held by the coil holding portion 111.

Figure 10:
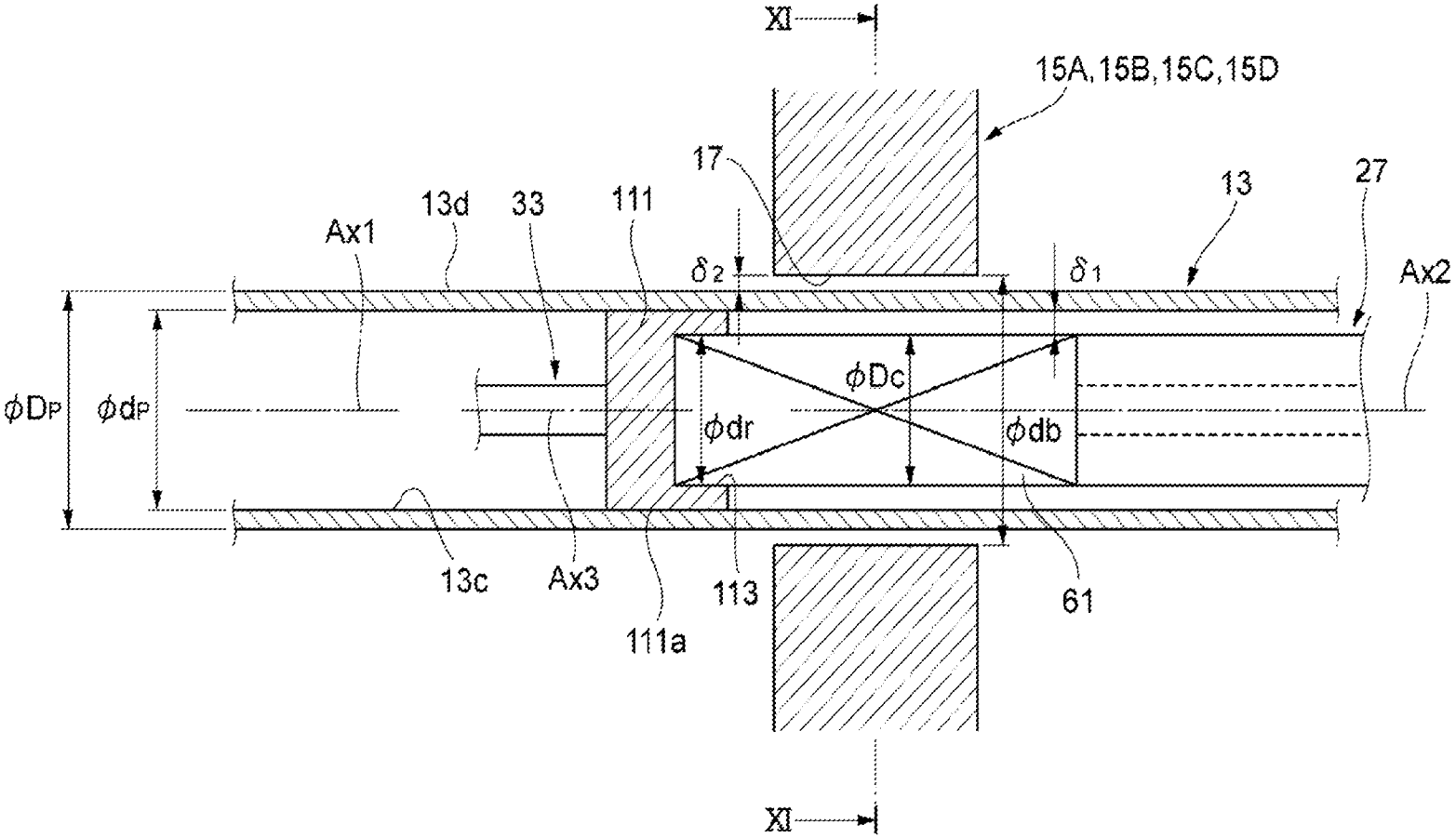
FIG. 10 is a sectional view for showing a state that a coil portion is held by the coil holding portion inside the pipe material.

FIG. 10 is a sectional view for showing a state that the coil portion 61 is held by the coil holding portion 111 inside the pipe material 13.

The coil holding portion 111 is moved while its cylindrical outer circumferential surface 111*a* slides on the inner circumferential surface 13*c* of the pipe material 13, and hits the coil portion 61. When the coil holding portion 111 hits the coil portion 61, an insertion tip portion of the coil portion 61 having an outer diameter $\phi Dc$ ($\approx\phi dr$) is fitted into the engagement recess 113 having the inner diameter $\phi dr$. In this manner, the insertion tip portion of the coil portion 61 is held by the coil holding portion 111 inside the pipe material 13.

Thus, the coil portion 61 is fixed to the inner circumferential surface of the pipe material 13 in the radial direction via the coil holding portion 111 at a position where the coil portion 61 overlaps with the bracket 15A As a result, inside the pipe material 13, the center axis Ax1 of the pipe material 13, the center axis Ax2 of the coil unit 27, and the center axis Ax3 of the support rod 33 (coil holding portion 111) coincide with each other.

The pipe material 13 is set coaxial with the through-holes 17 of the brackets 15A, 15B, 15C, and 15D by the above-described pipe material positioning members 45 and 47 (see FIG. 3). Thus, the center axes of the through-holes 17 are also set coincident with the center axis Ax1 of the pipe material 13. The inner diameter $\phi db$ of the through-holes 17 is larger than the outer diameter $\phi Dp$ of the pipe material 13 ($\phi Dp<\phi db$).

The pipe material 13 and the coil unit 27 are set coaxial with each other when the coil unit 27 is held by the coil holding portion 111. Alternatively, the pipe material 13 and the coil unit 27 may be kept coaxial with each other when the coil unit 27 is inserted into the pipe material 13. In this case, the coil unit 27 can be prevented reliably from interfering with the other members in inserting. This coaxial state can be maintained by adjusting the coil moving unit 87 such as the chucking unit 89 shown in FIG. 2.

Figure 11:
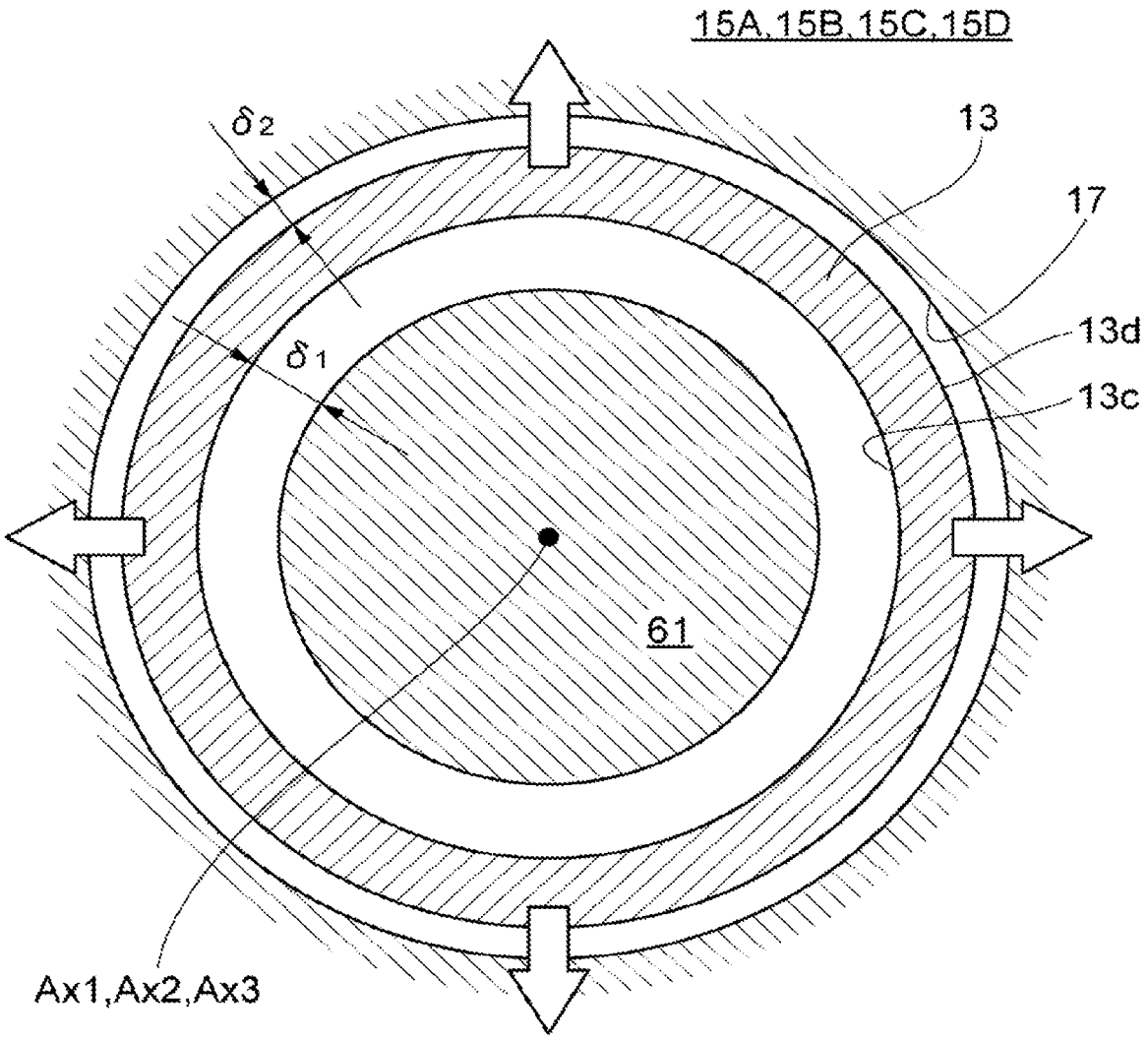
FIG. 11 is a schematic sectional view taken along line XI-XI in FIG. 10.

FIG. 11 is a schematic sectional view taken along line XI-XI in FIG. 10.

A gap $\delta 1$ that is uniform in the circumferential direction is formed between the coil portion 61 and the inner circumferential surface 13*c* of the pipe material 13 in the case where the coil holding portion 111 (see FIG. 10) supports the coil portion 61 coaxially. Furthermore, a gap $\delta 2$ that is uniform in the circumferential direction is formed between the through-hole 17 of the bracket 15A and the outer circumferential surface 13*d* of the pipe material 13.

(Swaging Step)

Next, the coil portion 61 is energized by the current supply unit 31 (see FIG. 2) in the state shown in FIG. 9B.

Figure 12:
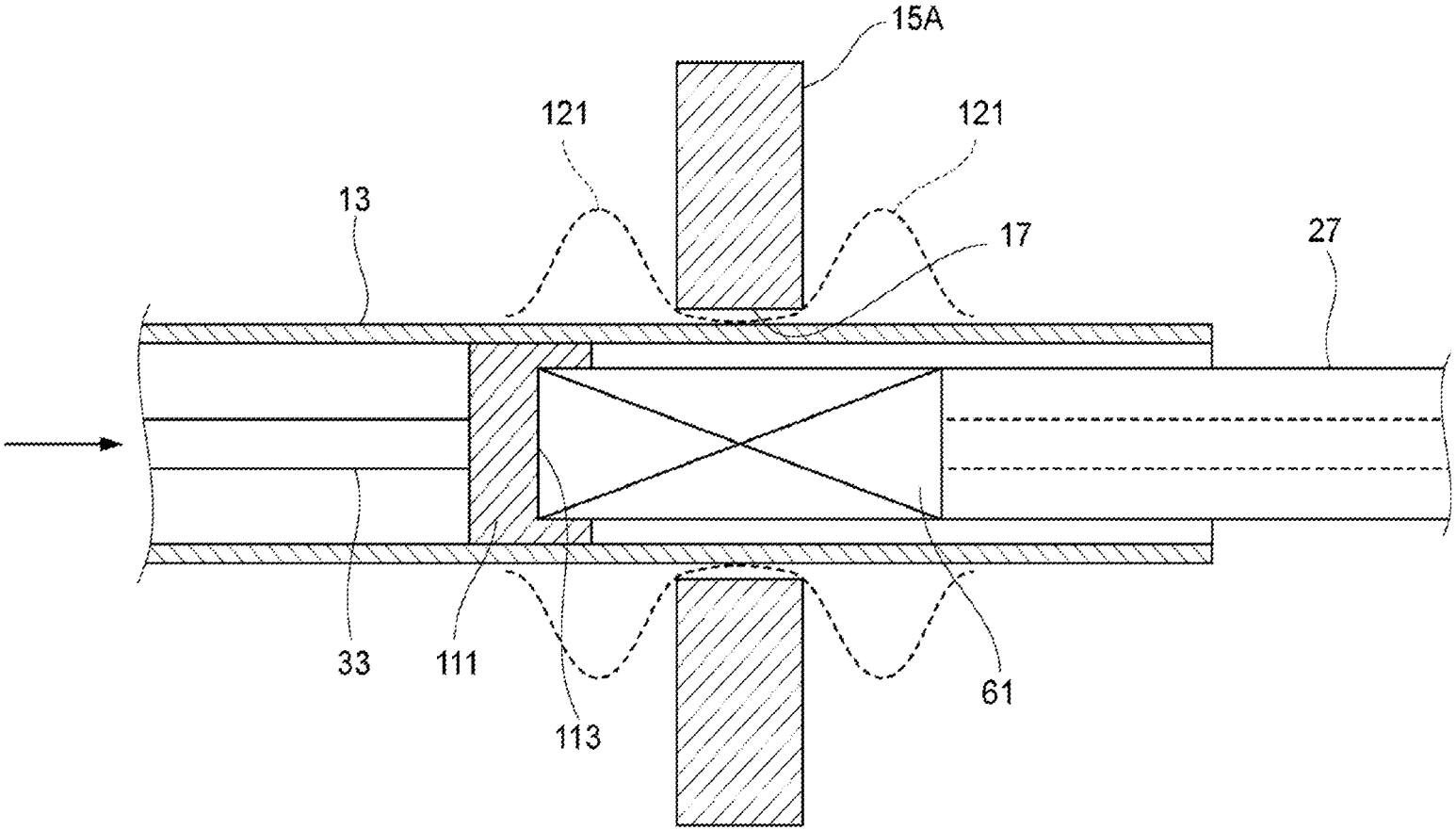
FIG. 12 is a schematic structure view for showing how electromagnetic formation is performed on the pipe material by the coil portion.

FIG. 12 is a schematic structure view for showing how electromagnetic formation is performed on the pipe material 13 by the coil portion 61. The bracket 15C and the pipe material positioning member 45 (see FIG. 9A) are omitted in FIG. 12.

Induction current is induced in the pipe material 13 at an axial position where the bracket 15A is disposed by a magnetic field generated by energization of the coil portion 61. The pipe material 13 is expanded by Lorentz force generated by the induction current in a manner indicated by broken lines in the figure.

At this time, since the bracket 15A is disposed at the center in the axial direction of the coil portion 61, the outer circumferential surface of the pipe material 13 is expanded and pressed against the through-hole 17 of the bracket 15A. Furthermore, ring-shaped swelled portions 121 are formed in the pipe material 13 on both sides of the bracket 15A in the axial direction in the axial region (strong magnetic field region) where the coil portion 61 exists. As a result, a pair of swelled portions 121 are formed so that the bracket 15A is sandwiched between them in the axial direction and the pipe material 13 is swaged onto the bracket 15A.

Expansion of the pipe material 13 by electromagnetic formation is performed also on the brackets 15B, 15C, and 15D shown in FIG. 9B in the same manner as described above. That is, after the pipe material 13 is expanded by electromagnetic formation at the axial position of one bracket (e.g., bracket 15A), the coil moving mechanism 29 cancels the restriction on the coil unit 27 in the axial direction and moves the coil portion 61 to the axial position of a bracket to be subjected to next electromagnetic formation. The support rod 33 is also moved so as to follow the coil portion 61 and to support the coil portion 61 at the movement destination inside the pipe material 13.

The coil holding portion 111 may be separated from the coil portion 61 at each electromagnetic formation position and be butted against the coil portion 61 again at the next electromagnetic formation position. Alternatively, the support rod 33 may be moved to the next electromagnetic formation position in the axial direction while the state where the coil holding portion 111 has been fitted with the coil portion 61 in the first expansion is maintained.

Figure 13:
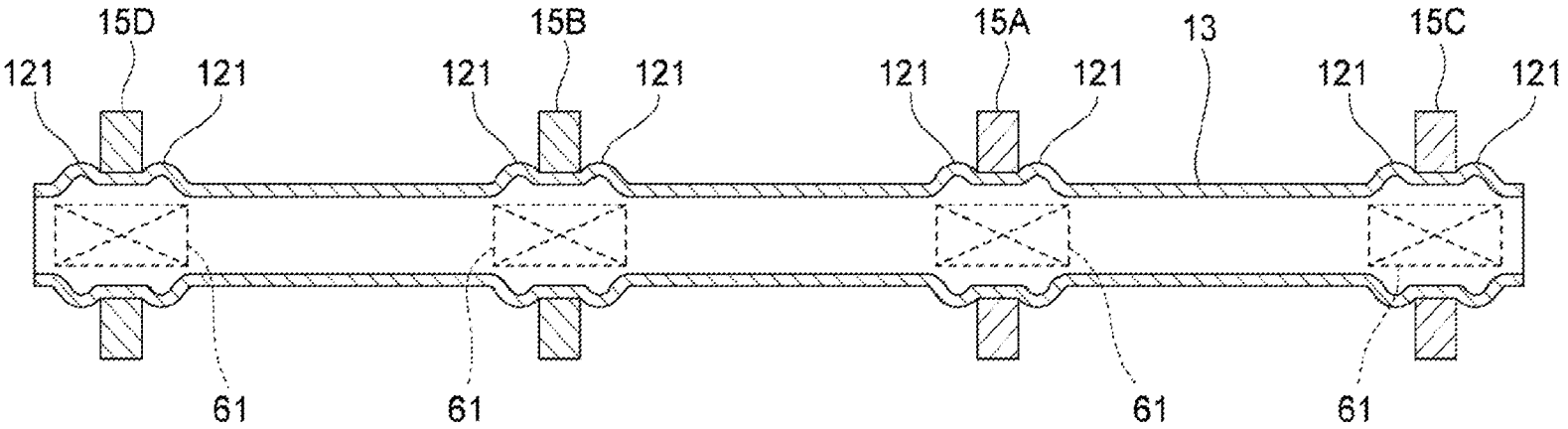
FIG. 13 is a schematic sectional view for showing a state after the electromagnetic formation on the pipe material.

FIG. 13 is a schematic sectional view for showing a state obtained after the electromagnetic formation on the pipe material 13 is finished.

The above-described expansion by electromagnetic formation is performed in order at the individual axial positions of the brackets 15A, 15B, 15C, and 15D As a result, the pipe material 13 is formed to have pairs of swelled portions 121 at the respective axial positions of the brackets 15A, 15B, 15C, and 15D, thereby performing swaging onto the 15A, 15B, 15C, and 15D.

After the above-described electromagnetic formation step, the fixing by the bracket holders 43A, 43B, 43C, and 43D (see FIG. 3) is canceled and a formed body in which the brackets 15A, 15B, 15C, and 15D have been fixed by swaging is taken out. Thus, the formed body 11 in the state shown in FIG. 1 is obtained.

<Advantages of Coaxial Arrangement of Pipe Material, Coil, Etc.>

In the electromagnetic forming machine 100 having the above configuration, the coil portion 61 is set coaxially with the pipe material 13 at each expansion position of the pipe material 13. The pipe material 13 is set coaxially with the through-holes 17 of the brackets 15A, 15B, 15C, and 15D. Furthermore, the coil portion 61 is fixed in the radial direction coaxially with the pipe material 13 inside the pipe material 13 by means of the coil holding portion 111 provided at the tip of the support rod 33. Thus, as shown in FIG. 11, the gap δ1 between the coil portion 61 and the pipe material 13 and the gap δ2 between the pipe material 13 and each of the brackets 15A, 15B, 15C, and 15D are made uniform in the circumferential direction with high accuracy.

Since the gap δ1 is uniform in the circumferential direction, a magnetic field generated by the coil portion 61 covers the pipe material 13 uniformly and induction current that is uniform in the circumferential direction is induced in the pipe material 13.

If the gap δ1 is not uniform in the circumferential direction, the pipe material 13 has a portion that is close to the coil portion 61 and a portion that is distant from the coil portion 61 depending on the circumferential position and the magnitude of the induction current differs. As a result, the electromagnetic force acting on the pipe material 13 has a variation to cause the plastic deformation amount to vary depending on the position in the pipe material 13.

Figure 24A:
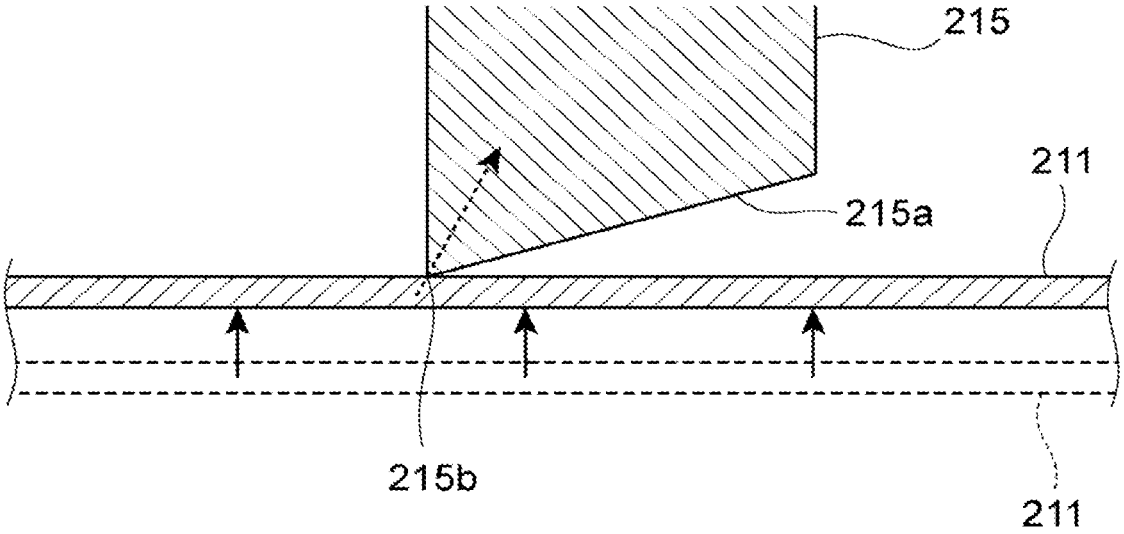
FIG. 24A is a schematic explanatory view for illustrating how the pipe material is expanded in the electromagnetic formation for the pipe material in a related art.
Figure 24B:
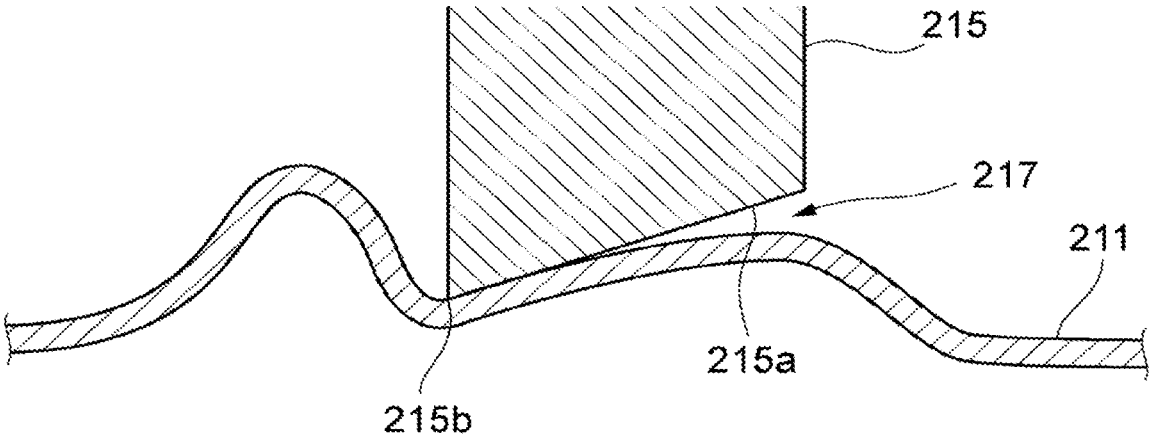
FIG. 24B is another schematic explanatory view for illustrating how the pipe material is expanded in the conventional electromagnetic formation for the pipe material in a related art.

In contrast, in the above-described configuration, since the gap δ1 can be made uniform in the circumferential direction, uniform electromagnetic force acts on the pipe material 13 radially and the pipe material 13 is plastically deformed uniformly. As a result, occurrence of insufficient expansion illustrated as the region 217 shown in FIG. 24B can be prevented.

Furthermore, since the gap 52 is uniform in the circumferential direction, the outer circumferential surface of a portion that expands in the circumferential direction and has been plastically deformed uniformly hits each of the bracket 15A, 15B, 15C, or 15D at the same time with approximately the same electromagnetic force. As a result, swelled portions 121, which are formed by swelling of the pipe material 13 in both sides in the axial direction of each of the bracket 15A, 15B, 15C, or 15D, are formed uniformly in the circumferential direction.

In the case where each bracket (pipe periphery member) is a metal member, if the pipe material 13 touches the ends of the through-hole 17 of the bracket with a difference in time in expanding, induction current induced in the pipe material 13 escapes from the first contact point to the bracket. As a result, the deformation amount is large at the first contact point and small in other portions, and swelled portions 121 have shapes that are not uniform in the circumferential direction and the radial direction. In this case, the intensity of swaging of the pipe material 13 onto the bracket becomes insufficient.

In contrast, in the electromagnetic forming machine 100 having the above configuration, since the pipe material 13 and the through-hole 17 of each bracket are positioned coaxially, the gap δ2 becomes uniform in the circumferential direction and the pipe material 13 touches the ends of the through-hole 17 of the bracket without a difference in time. As a result, swelled portions 121 of the pipe material 13 are formed uniformly in the circumferential direction and the pipe material 13 is swaged onto the bracket strongly and uniformly in the circumferential direction. In this manner, the long pipe material 13 can be joined to each of the brackets 15A, 15B, 15C, and 15D in a uniform swaging state.

<Second Electromagnetic Forming Method>

Next, the procedure of a second electromagnetic forming method will be described.

Figure 14A:
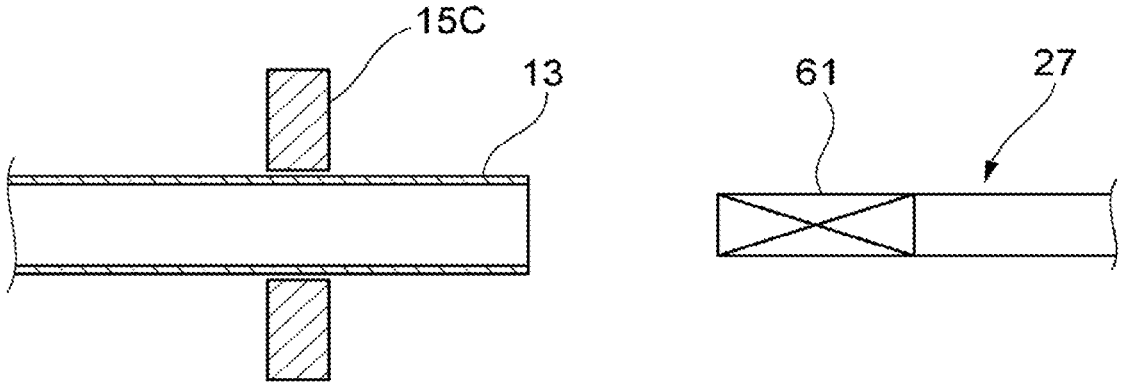
FIG. 14A is a process explanation view for illustrating the procedure of a coil unit holding step and a coil moving step of a second electromagnetic forming method.
Figure 14B:
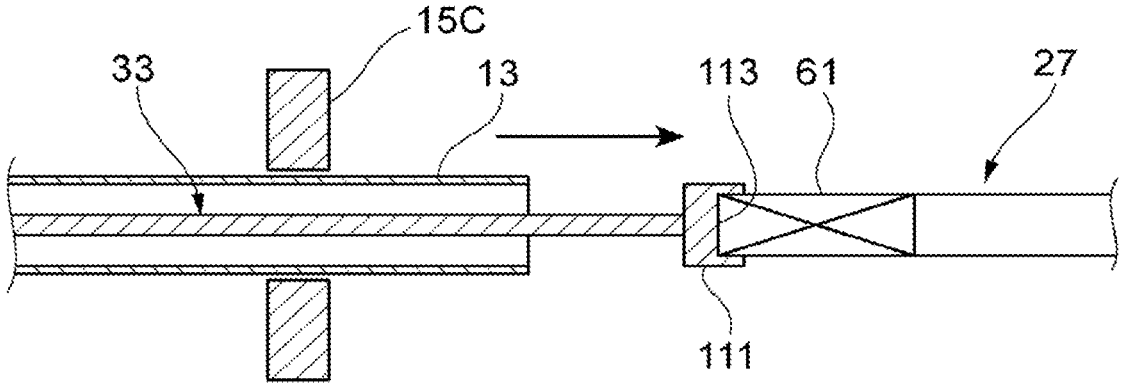
FIG. 14B is another process explanation view for illustrating the procedure of the coil unit holding step and the coil moving step of the second electromagnetic forming method.
Figure 14C:
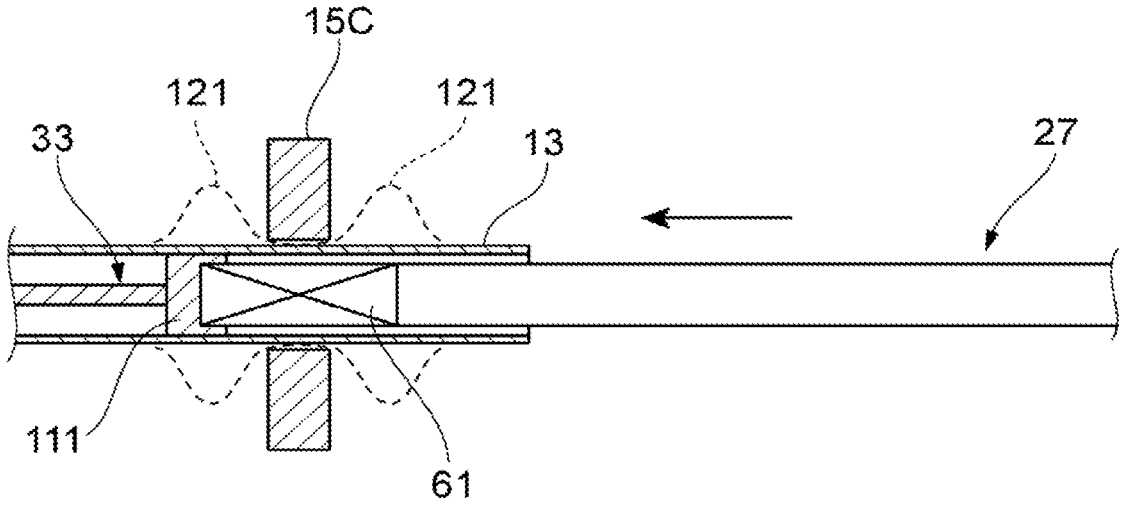
FIG. 14C is a further process explanation view for illustrating the procedure of the coil unit holding step and the coil moving step of the second electromagnetic forming method.

FIG. 14A to FIG. 14C are process explanation views for illustrating the procedure of a coil unit holding step and a coil moving step of the second electromagnetic forming method. In the following description, members and portions being the same as the aforementioned ones will be given the same symbols, and the description therefor will be simplified or omitted.

The second electromagnetic forming method is the same in procedure as the above-described first electromagnetic forming method except that the coil unit holding step is performed before the coil moving step.

First, as shown in FIG. 9A that was referred to above, a pipe material 13 are inserted into the through-holes 17 of respective brackets 15A, 15B, 15C, and 15D and two end portions, in the pipe axial direction, of the pipe material 13 are supported by the respective pipe material positioning members 45 and 47. In this state, as shown in FIG. 14A, the coil portion 61 of the coil unit 27 is disposed outside the one end, in the axial direction, of the pipe material 13.

Then, as shown in FIG. 14B, the support rod 33 is inserted into the pipe material 13 from the other end of the pipe material 13 and is caused to project beyond the one end of the pipe material 13 and hit a tip portion, located on the side of the pipe material 13, of the coil portion 61. As a result, the tip portion of the coil portion 61 is fitted into the engagement recess 113 of the coil holding portion 111 and the coil unit 27 is supported so as to be coaxial with the support rod 33.

Then, as shown in FIG. 14C, the coil unit 27 is moved toward the pipe material 13 with the tip portion of the coil portion 61 kept held by the coil holding portion 111, and the coil portion 61 is caused to be located at a position (expansion position) where it overlaps with the bracket 15C. At this time, the support rod 33 is pulled back to the inside of the pipe material 13 in accordance with the movement of the coil unit 27 and fixes the coil unit 27 in the radial direction inside the pipe material 13. Furthermore, movement of the coil portion 61 in the axial direction is restricted because the coil unit 27 is fixed by the coil moving unit (not shown).

After the coil portion 61 has been set at the position where it overlaps with the bracket 15C, the pipe material 13 is expanded by energizing the coil portion 61. A portion, facing the coil portion 61, of the pipe material 13 is deformed plastically toward the bracket 15C, and swelled portions 121 are formed on the two respective sides, in the axial direction, of the bracket 15C. As a result, the pipe material 13 is swaged onto the bracket 15C.

In this procedure, since the coil holding portion 111 is fitted with the coil portion 61 outside the pipe material 13, a state of holding of the coil portion 61 by the coil holding portion 111 can be checked easily. Furthermore, a holding state can be finely adjusted with high workability. Thus, a failure of engagement between the coil holding portion 111 and the coil portion 61 is less likely to occur and hence electromagnetic formation can be performed with high accuracy.

Furthermore, since the coil portion 61 is set at the position where it overlaps with the bracket 15C while the coil unit 27 is held by the support rod 33, the coil unit 27 is moved inside the pipe material 13 while being guided by the support rod 33. As a result, the coil portion 61 can be set at the position where it overlaps with the bracket 15C without interfering with (being caught on) the pipe material 13, and the coil unit 27 can be positioned easily in the axial direction. Furthermore, a position of the coil unit 27 in the axial direction can be finely adjusted such that even more accurate electromagnetic formation is enabled.

Although in the above procedure the coil unit 27 and the coil holding portion 111 of the support rod 33 are butted against each other outside the pipe material 13, they may be butted against each other inside the pipe material 13 and then pulled out of the pipe material 13 to check their engagement. In this case, the coil unit 27 and the coil holding portion 111 of the support rod 33 are restricted in the radial direction of the pipe material 13 when they are butted against each other, they can be positioned easily so as to be coaxial with each other.

<Third Electromagnetic Forming Method>

Next, the procedure of a third electromagnetic forming method will be described.

Figure 15:
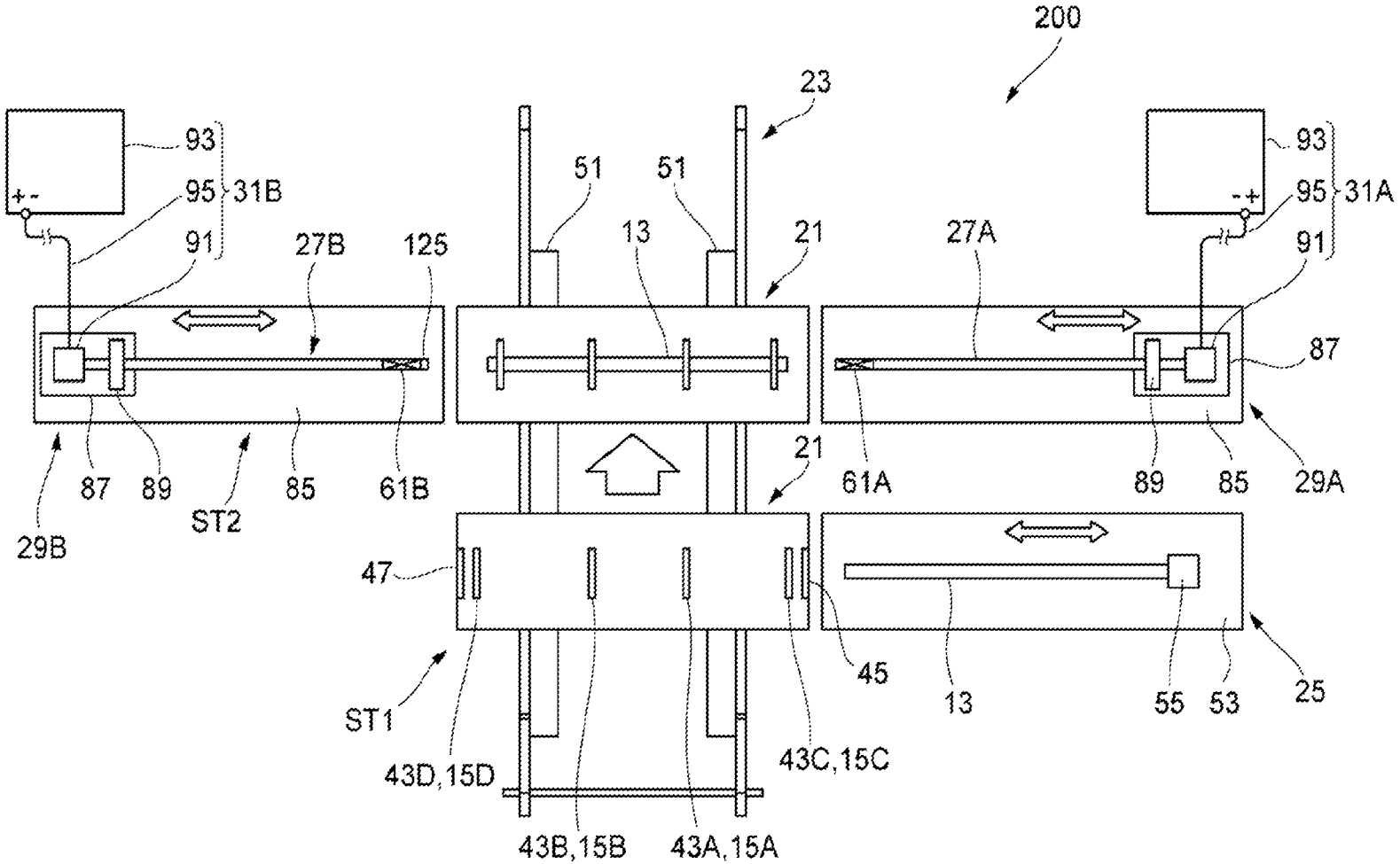
FIG. 15 is a schematic plan view of an electromagnetic forming machine to perform a third electromagnetic forming method.

FIG. 15 is a schematic plan view of an electromagnetic forming machine 200 which performs the third electromagnetic forming method.

The electromagnetic forming machine 200 includes plural jig plates 21, a jig plate conveying mechanism 23, a pipe material insertion mechanism 25, coil units 27A and 27B, coil moving mechanisms 29A and 29B, current supply units 31A and 31B, and a coil holding portion 125. The coil moving mechanisms 29A and 29B and the current supply units 31A and 31B have the same configuration as those of the coil moving mechanism 29 and the current supply unit 31 of the above-described electromagnetic forming machine 100, respectively.

The electromagnetic forming machine 200 includes the coil moving mechanism 29B as an inverted (in the axial direction) version of the coil moving mechanism 29A, in place of the support rod moving mechanism 35 (see FIG. 2) of the above-described electromagnetic forming machine 100. Furthermore, the coil holding portion (support member) 125 is attached to an insertion-side tip portion of the coil unit 27B which is supported by the coil moving mechanism 29. That is, the coil unit 27B and the coil moving mechanism 29B of this configuration also function as the above-described support rod 33 and support rod moving mechanism 35, respectively.

Figure 16:
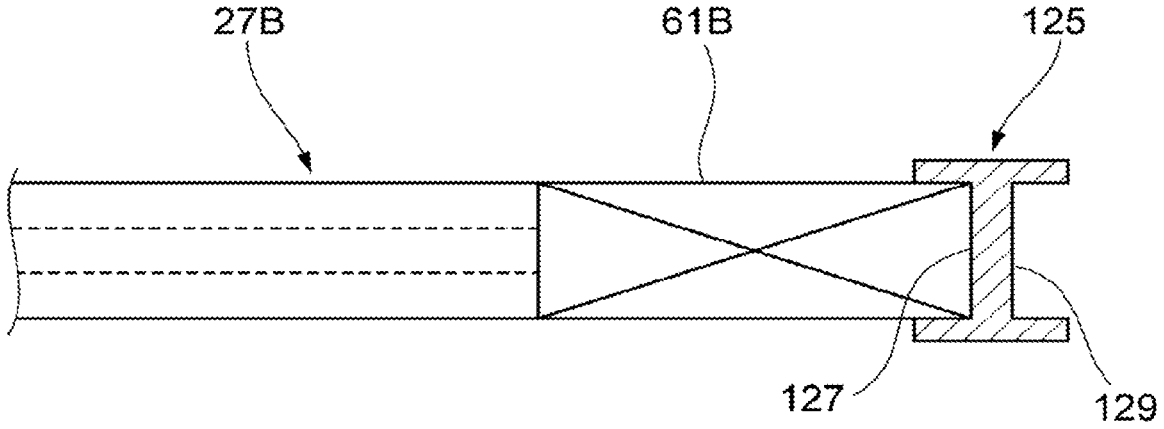
FIG. 16 is a schematic enlarged view of an insertion-side tip portion of a coil unit.

FIG. 16 is a schematic enlarged view of the insertion-side tip portion of the coil unit 27B.

The coil holding portion 125 which is attached to the insertion-side tip portion of a coil portion 61B is formed with engagement recesses 127 and 129 at its two respective ends in the axial direction. The one engagement recess 127 is fitted with a tip portion of the coil portion 61B and the coil holding portion 125 is thus integrated with the coil unit 27B.

The engagement recess 129 of the coil holding portion 125 has the same shape as the engagement recess 113 of the above-described coil holding portion 111. As described later, the engagement recess 129 is to be fitted with the tip portion of the coil portion 61A of the coil unit 27A shown in FIG. 15.

Figure 17:
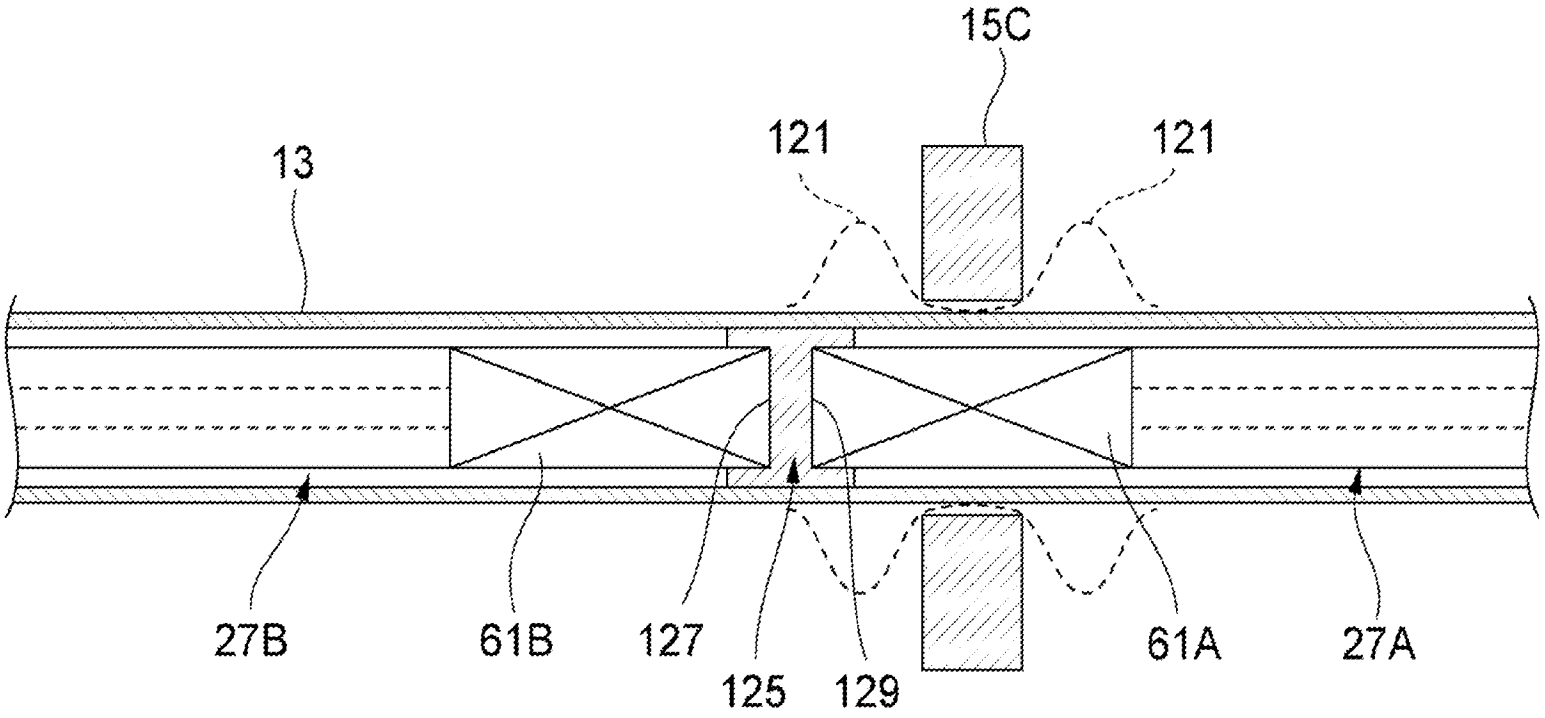
FIG. 17 is a schematic structure view for illustrating how electromagnetic formation is performed on a pipe material by a coil portion of the electromagnetic forming machine shown in FIG. 15.

FIG. 17 is a schematic structure view for illustrating how electromagnetic formation is performed on the pipe material 13 by the coil portion 61A of the electromagnetic forming machine 200 shown in FIG. 15.

The coil unit 27A is inserted from the one end (right end in FIG. 17) of the pipe material 13 and set at a position where the coil portion 61A overlaps with the bracket 15C. The coil unit 27B is inserted from the other end (left end in FIG. 17) of the pipe material 13 and the insertion-side tip portion of the coil portion 61A is held by the coil holding portion 125 attached to the insertion-side tip portion. By energizing the coil portion 61A in this state, the pipe material 13 is expanded and swaged onto the bracket 15C.

With this configuration, the pipe material 13 can be expanded by inserting the plural coil units 27A and 27B into the pipe material 13. As a result, the steps of inserting the above-described support rod 33 (see FIG. 2) into the pipe material 13 and performing electromagnetic formation, pulling out the support rod 33 after the electromagnetic formation, and inserting the coil unit again from the support rod 33 insertion side and performing electromagnetic formation can be omitted. The productivity can thus be increased remarkably. In addition, the accuracy of electromagnetic expansion is increased because centering of both of the coil portions 61A and 61B can be made by the coil holding portion 125 which is attached to the tip portion of the coil portion 61B.

Although in the above example the coil holding portion 125 is attached to the coil unit 27B, the coil holding portion 125 may be attached to the coil unit 27A.

Furthermore, although in the above process the coil unit 27A and the coil holding portion 125 are butted against each other at a position (inside the pipe material 13) where the coil portion 61A overlaps with the bracket 15C, they may be butted against each other at a position inside the pipe material 13 other than such a position that the coil portion 61A overlaps with the bracket 15C. In this case, the coil portion 61A can be moved to the position where the coil portion 61A overlaps with the bracket 15C by moving the coil units 27A and 28B together while the coil unit 27A is kept held by the coil holding portion 125. This makes it possible to finely adjust the axial position of the coil portion 61A and hence to perform electromagnetic formation with even higher accuracy.

Still further, the coil unit 27A and the coil holding portion 125 may be butted against each other outside the pipe material 13. In this case, bending of the coil unit 27A can be reduced and hence the coil units 27A and 28B can adjusted easily so as to be coaxial with each other. Furthermore, a state of holding of the coil unit 27A by the coil holding portion 125 can be checked easily and can be finely adjusted with high workability. As a result, the coil unit and the support member can be easily positioned so as to be coaxial with each other, the coil unit can be held reliably, and electromagnetic formation can be performed with high accuracy.

Figure 18:
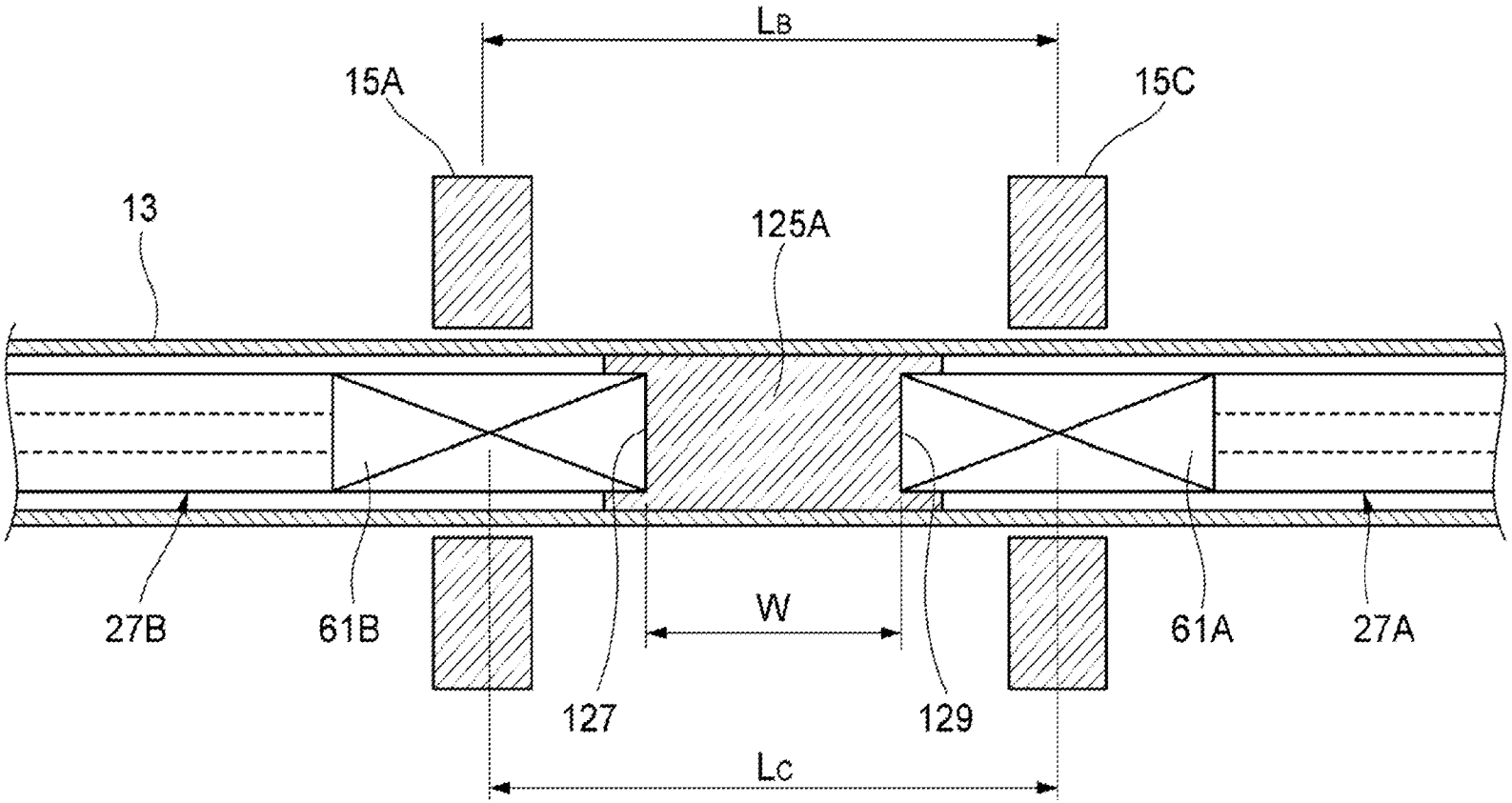
FIG. 18 is a schematic structure view for illustrating how electromagnetic formation is performed on a pipe material using a coil holding portion whose axial length is adjusted.

FIG. 18 is a schematic structure view for illustrating how electromagnetic formation is performed on the pipe material 13 using a coil holding portion 125A whose axial length is adjusted.

The axial distance W between the bottom surfaces of the engagement recesses 129 and 127 for receiving the insertion-side tip portions of the coil portions 61A and 61B, respectively, is determined depending on an axial interval $L_B$ between adjacent brackets (e.g., brackets 15A and 15C).

The illustrated example is directed to the case where electromagnetic formation is performed on the pipe material 13 at each of the axial positions of the brackets 15A and 15C. Now, the center of the coil portion 61A is set at an axial position where the center of the coil portion 61A overlaps with the bracket 15C and the center of the coil portion 61B is set at an axial position where the center of the coil portion 61B overlaps with the bracket 15A. The axial interval between the centers of the coil portions 61A and 61B in this state is represented by $L_C$.

In this case, the axial length W of the coil holding portion 125A is set such that the axial intervals $L_C$ and $L_B$ are identical ($L_C$=$L_B$). In such a configuration, since the coil portions 61A and 61B of the coil units 27A and 27B are held by the coil holding portion 125A, when the one coil portion 61A is set at a position where the one coil portion 61A overlaps with the bracket 15C, the other coil portion 61B is positioned at a position where the other coil portion 61B overlaps with the bracket 15A.

The pipe material 13 can be expanded at one time at the axial positions of the brackets 15A and 15C by energizing the coil portions 61A and 61B at the same time or successively in the state that the coil portions 61A and 61B are set as shown in FIG. 18. As a result, the swaging step is simplified and the takt time of an electromagnetic forming process can be shortened.

<Fourth Electromagnetic Forming Method>

Next, the procedure of a fourth electromagnetic forming method will be described.

Figure 19:
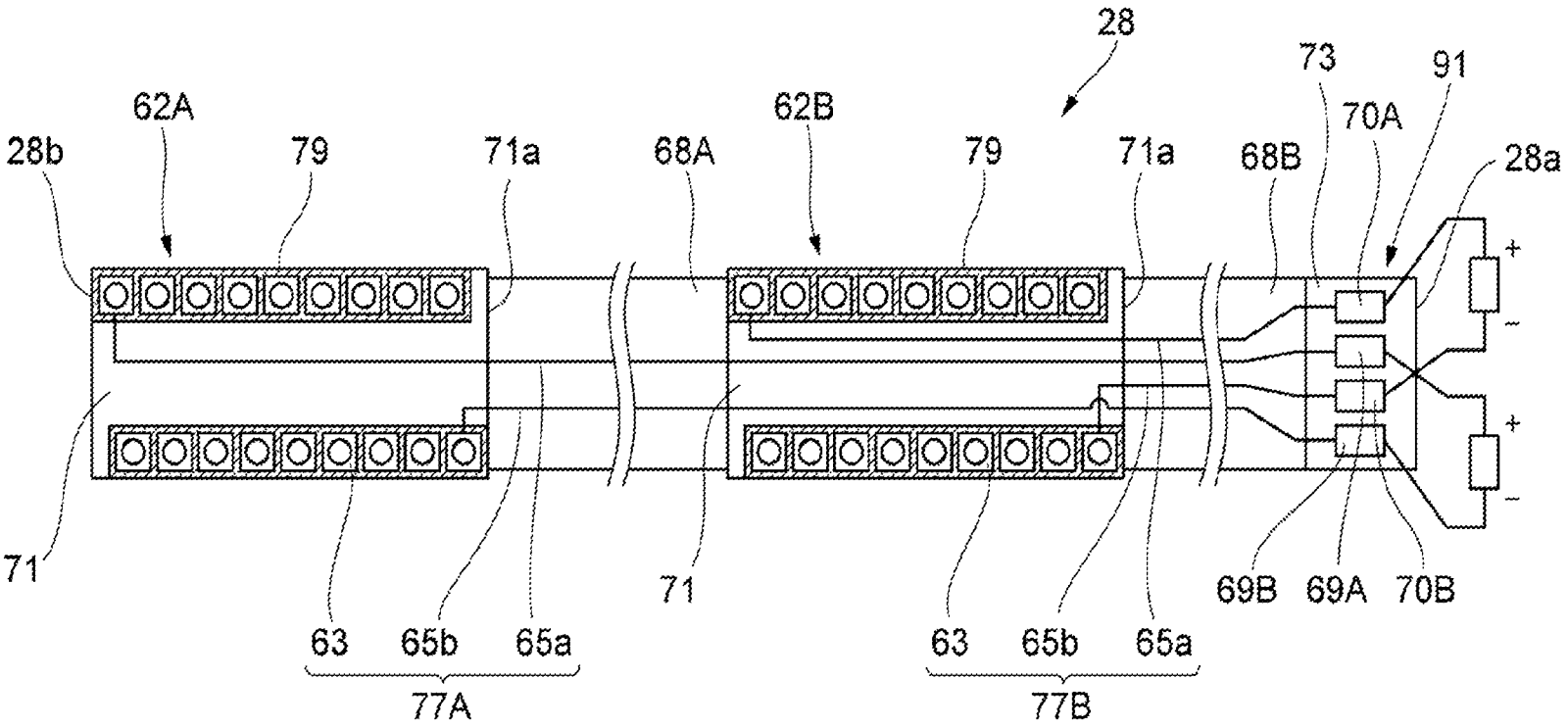
FIG. 19 is a schematic configuration view of a coil unit used in a fourth electromagnetic forming method.

FIG. 19 is a schematic view for showing the configuration of a coil unit that is used in the fourth electromagnetic forming method.

In the coil unit 28 having this configuration, coil portions 62A and 62B are disposed at plural (two in the example of FIG. 19) positions arranged in the axial direction. The coil portions 62A and 62B have the same configuration as the above-described coil portion 61.

The coil portions 62A and 62B are coil portions that are independent of each other and are to be energized individually. A conductor support portion 68A is provided so as to extend between the coil portions 62A and 62B and a conductor support portion 68B is provided so as to extend between the coil portion 62B and a base end 28*a*.

In a terminal connection portion 91, coil terminal portions 69A and 69B are connected to the base ends of conductor extension portions 65*a* and 65*b* that extend from the coil portions 62A, respectively. Coil terminal portions 70A and 70B are connected to the base ends of conductor extension portions 65*a* and 65*b* that extend from the coil portions 62B, respectively.

Figure 20A:
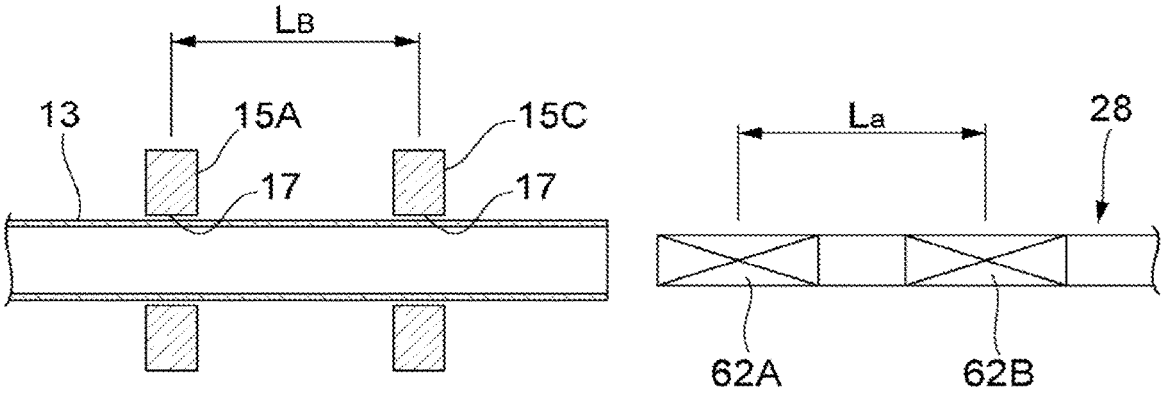
FIG. 20A is a process explanation view for illustrating the procedure of a coil moving step for moving the coil unit used in the fourth electromagnetic forming method, a coil unit holding step, and a swaging step.
Figure 20B:
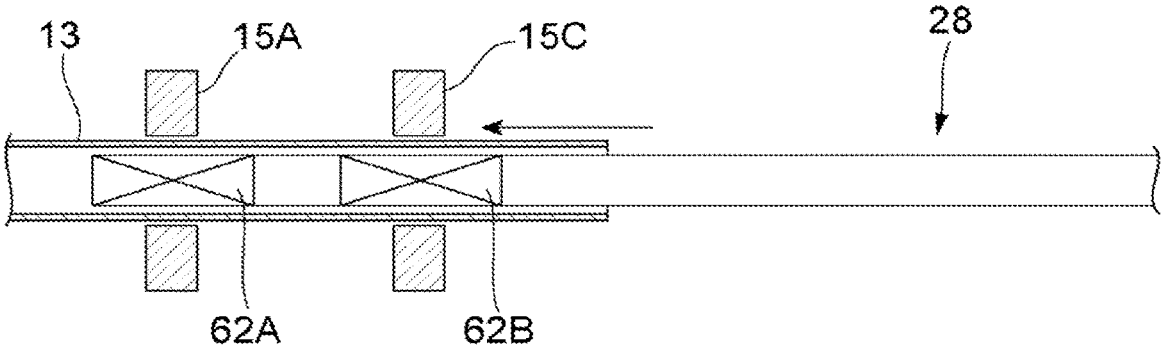
FIG. 20B is a process explanation view for illustrating the procedure of the coil moving step for moving the coil unit used in the fourth electromagnetic forming method, the coil unit holding step, and the swaging step.
Figure 20C:
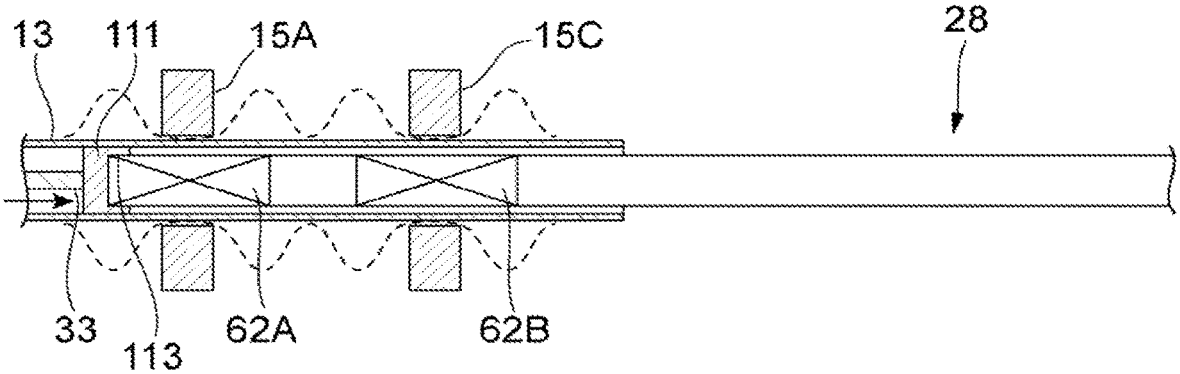
FIG. 20C is a process explanation view for illustrating the procedure of the coil moving step for moving the coil unit used in the fourth electromagnetic forming method, the coil unit holding step, and the swaging step.

FIG. 20A to FIG. 20C are process explanation views for illustrating the procedure of a coil moving step for moving the coil unit 28 used in the fourth electromagnetic forming method, a coil unit holding step, and a swaging step.

The coil unit 28 is set on the side of one end of the pipe material 13 as shown in FIG. 20A and then inserted into the pipe material 13 as shown in FIG. 20B. In the coil unit 28, the axial interval La between the centers of the coil portions 62A and 62B are set equal to the axial interval $L_B$ between the brackets 15A and 15C. Thus, the coil portions 62A and 62B are set at positions where they overlap with the respective brackets 15A and 15C at one time merely by inserting the coil portions 62A and 62B into the pipe material 13.

Then the support rod 33 is inserted into the pipe material 13 from the other end of the pipe material 13, and the coil holding portion (support member) 111 which is provided at the tip of the support rod 33 butts against the coil portion 62A. The engagement recess 113 is fitted with the tip portion of the coil portion 62A such that the coil holding portion 111 holds the coil unit 28 inside the pipe material 13.

In this manner, the coil portions 62A and 62B are positioned so as to be coaxial with the pipe material 13. The pipe material 13 is positioned so as to be coaxial with the through-holes 17 of the brackets 15A and 15C by pipe material positioning members (not shown). Furthermore, axial movement of the coil unit 28 is restricted by a coil moving unit (not shown).

Then, as shown in FIG. 20C, the pipe material 13 is expanded and swelled portions 121 are formed by energizing the coil portions 62A and 62B being fixed inside the pipe material 13, thereby swaging the pipe material 13 onto the brackets 15A and 15C.

Also in this case, the coil portions 62A and 62B may be set at respective desired expansion positions by causing the coil holding portion 111 to butt against and hold the coil portion 62A inside the pipe material 13 at a position where the coil portion 62A does not overlap a bracket or outside the pipe material 13, and then moving the support rod 33 and the coil unit 28 together with the coil portion 62A kept held by the coil holding portion 111. Alternatively, the electromagnetic formation may be performed as the following: one of the coil portions 62A and 62B is set at a position where it overlaps with one of the brackets 15A and 15C and electromagnetic formation is performed and then the other of the coil portions 62A and 62B is set at a position where it overlaps with the other of the brackets 15A and 15C and electromagnetic formation is performed. In this manner, the coil portions 62A and 62B provided at the plural positions of the coil unit 28 may be used for electromagnetic formation successively.

Although the coil unit 28 having the above configuration is provided with the coil portions 62A and 62B at the two positions arranged in the longitudinal direction, the number of coil portions provided is not limited to two and may be three or more.

With the coil unit 28 having the above configuration, the individual coil portions can be positioned with high accuracy so as to be coaxial with the pipe material 13 because they are provided so as to be integrated with each other. Thus, the coil portions do not suffer different setting deviations and the positioning accuracy can be increased easily. As a result, work of positioning the coil portions is simplified, the working efficiency is increased, and the takt time is shortened.

Figure 21:
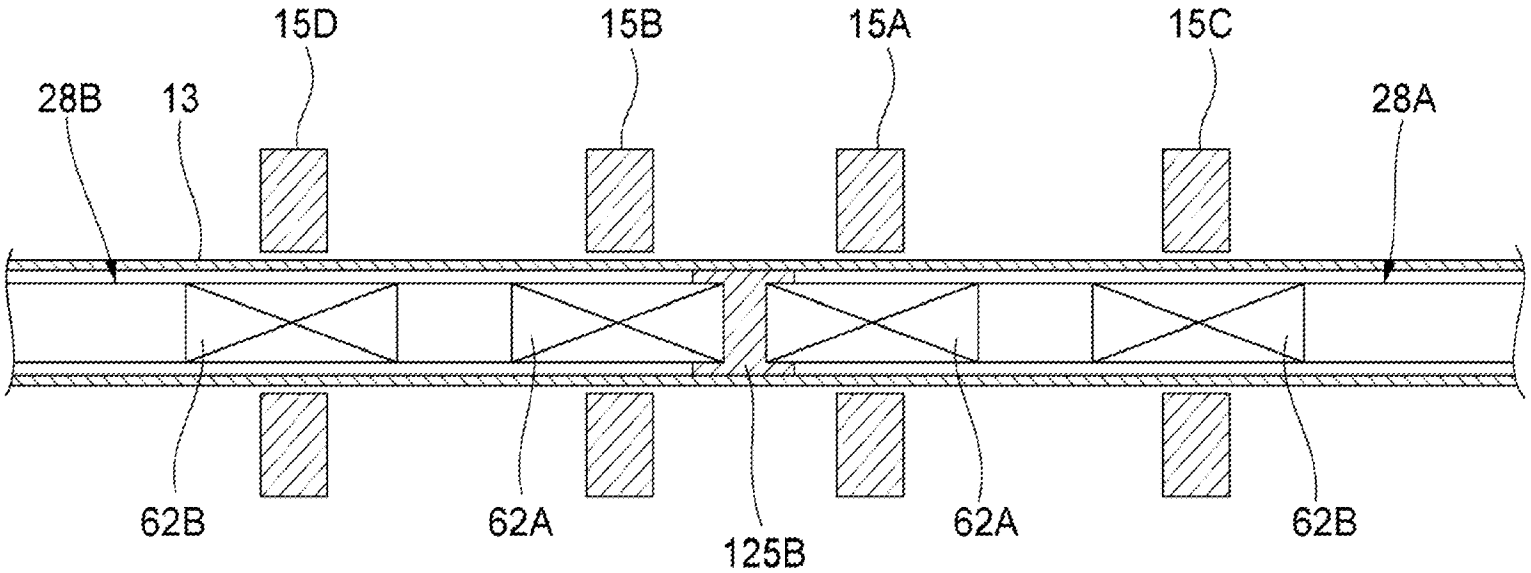
FIG. 21 is a process explanation view for illustrating how electromagnetic formation to form brackets together is performed by inserting a pair of coil units from the two ends, in the axial direction, of a pipe material.

FIG. 21 is a process explanation view for illustrating how electromagnetic formation involving the brackets 15A, 15B, 15C, and 15D is performed at one time by inserting a pair of coil units 28A and 28B from each of the two ends, in the axial direction, of the pipe material 13.

Each of the coil units 28A and 28B has the same configuration as the above-described coil unit 28. A coil holding portion 125B is attached to an insertion-side tip portion of at least one of the coil units 28A and 28B. In this configuration, the coil holding portion 125B is provided on the side of the coil unit 28B.

The coil unit 28A is inserted from the one end of the pipe material 13 and the coil unit 28B is inserted from the other end of the pipe material 13. A coil portion 62A of the coil unit 28A and the coil holding portion 125B of the coil unit 28B butt against each other and the coil portion 62A of the coil unit 28A is held by the coil holding portion 125B.

As in the case shown in FIG. 18, the axial length of the coil holding portion 125B is set depending on the axial interval between the brackets 15A and 15B shown in FIG. 21. As in the case shown in FIG. 20A, the axial interval between the coil portions 62A and 62B is set equal to the axial interval between the brackets 15A and 15C and the axial interval between the brackets 15B and 15D shown in FIG. 21.

Thus, when the coil portion 62A of the coil unit 28A (or 28B) is positioned at a position where it overlaps with the bracket 15A (or 15B), all of the coil portions 62A and 62B are set at respective expansion positions, that is, positions where they overlap with the respective brackets 15A, 15B, 15C, and 15D.

Thus, in this configuration, all the coil portions can be set at desired axial positions by positioning at least one of the plural coil portions in the axial direction. As a result, work of positioning the coil portions can be made simpler, the working efficiency can be increased, and the takt time can be shortened. Also in this case, each of the coil portions 62A and 62B may be set at a desired expansion position by causing the coil holding portion 125B to butt against and hold the coil portion 62A inside the pipe material 13 at a position where the coil portion 62A does not overlap with a bracket or outside the pipe material 13 and then moving the coil units 28A and 28B together with the coil portion 62A kept held by the coil holding portion 125B.

The invention is not limited to the above embodiments. In the invention, it is expected that constituent elements of embodiments are combined together and those skilled in the art make changes or conceive applications on the basis of the disclosure of the specification and common techniques and what result from those acts are included in the scope of protection.

Figure 22:
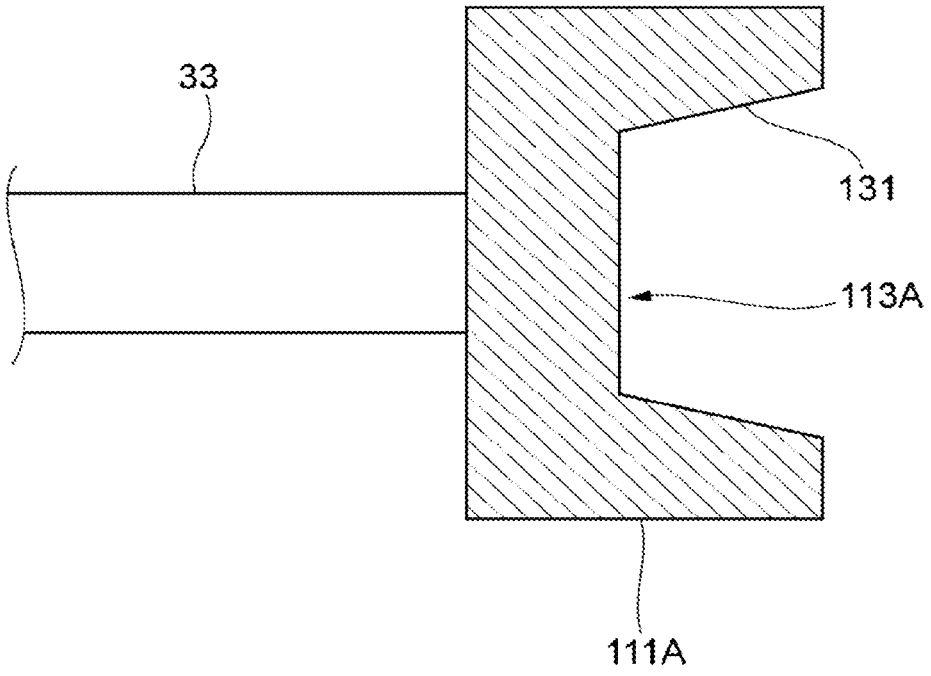
FIG. 22 is a schematic sectional view for showing another example of engagement recess of a coil holding portion.
Figure 23A:
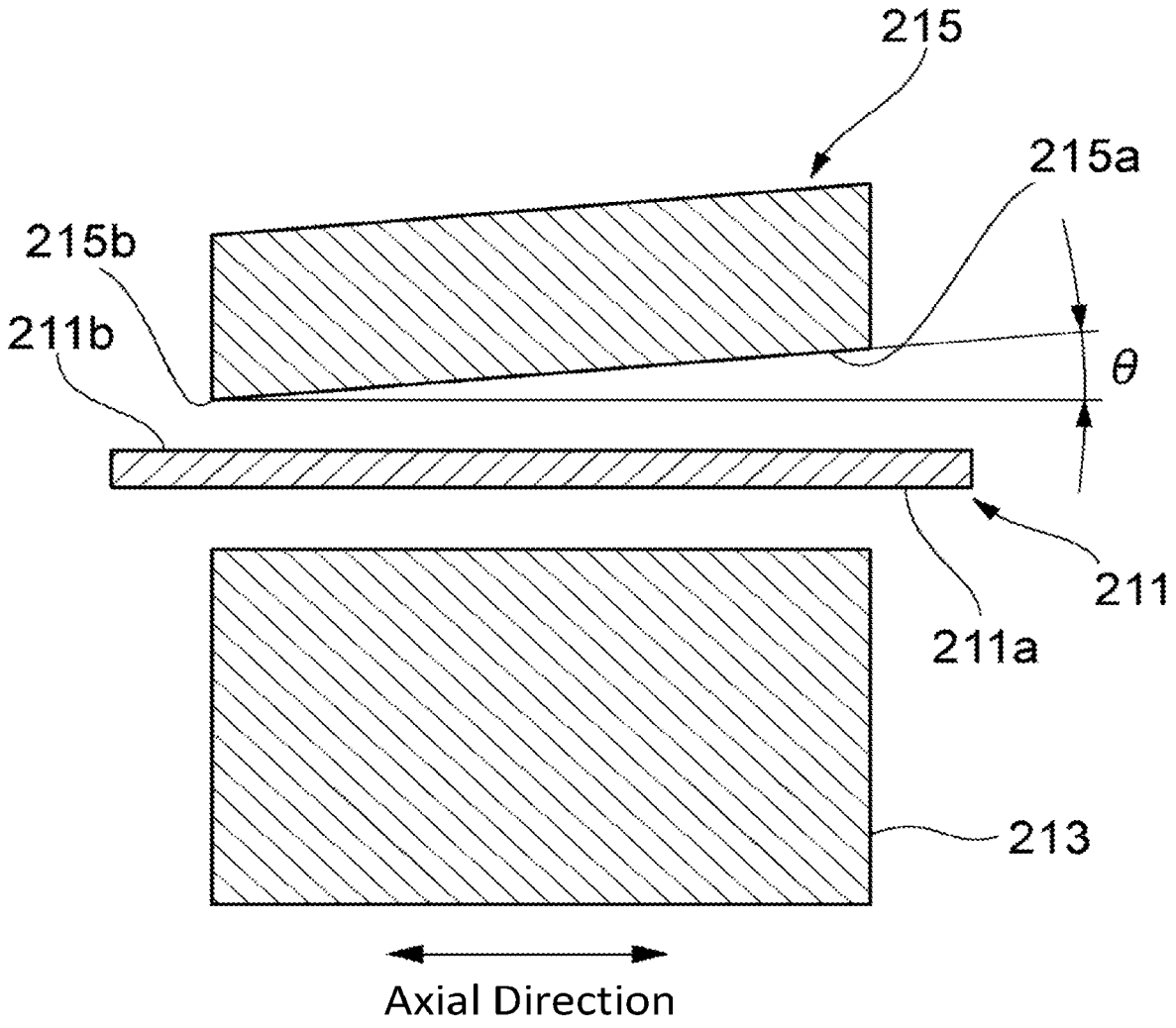
FIG. 23A is a partial sectional view for showing how electromagnetic formation for a pipe material in a related art is performed.
Figure 23B:
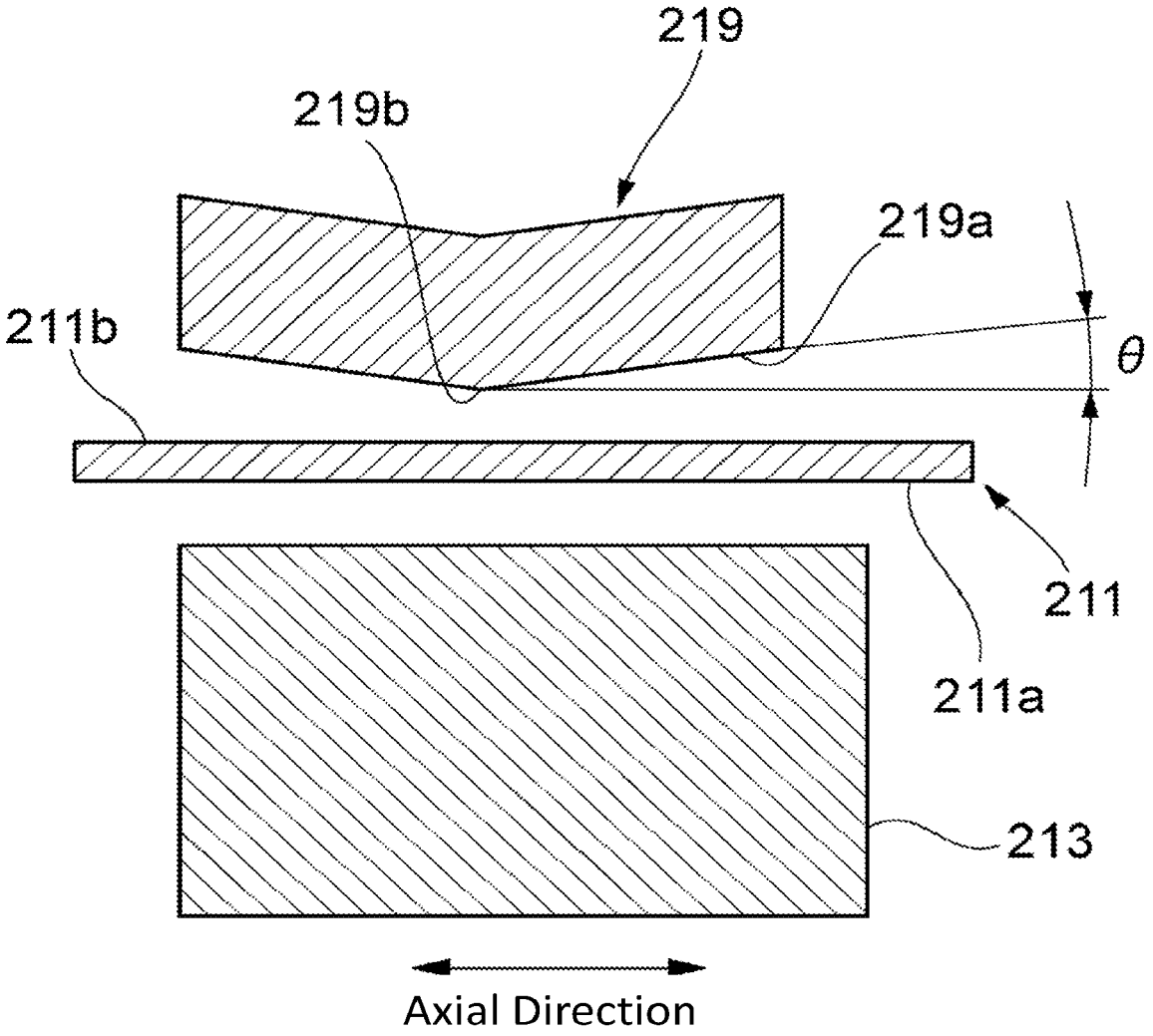
FIG. 23B is another partial sectional view for showing how the electromagnetic formation for the pipe material in a related art is performed.

Although the engagement recess of the coil holding portion is illustrated as a bottom-closed recess having a cylindrical inner circumferential surface, the shape of the engagement recess is not limited to this shape. For example, as shown in FIG. 22, a coil holding portion 111A may have an engagement recess 113A having a side surface 131 that is tapered in a cross section taken perpendicularly to the axis such that the diameter of the engagement recess 113A decreases gradually toward the insertion (directed to the coil portion) tail side (leftward in FIG. 22).

In this case, when the coil holding portion 111A is caused to butt against the coil portion, the coil portion is fitted into the engagement recess 113A while being guided by the side surface 131. Thus, the coil portion can be held coaxially with the support rod 33 with high accuracy even when the coil portion is off-centered a little, because the coil portion is inserted into the engagement recess 113A while being guided by the side surface 131.

Alternatively, the coil holding portion 111 may have a projection to be fitted into a recess formed on the coil portion side. That is, the engagement recess 113 may have any shape as long as the two sides are arranged coaxially as a result of fitting of a projection of one side into a recess of the other side.

As described above, the specification discloses the following items.

(1) An electromagnetic forming method, including:

a step of setting pipe periphery members at plural positions along an axial direction of a pipe material;

a step of setting a coil unit on a side of one end, in the axial direction, of the pipe material, the coil unit including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a step of setting a support member on a side of the other end, in the axial direction, of the pipe material, in which at least a tip of the support member on a side of the pipe material is made of an insulator;

a coil unit holding step of causing the coil unit and the support member to butt against each other by relatively moving the coil unit and the support member to each other in the axial direction of the pipe material, thereby causing the tip portion of the support member to hold the coil unit coaxially;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit, in which the coil setting step and the swaging step are performed in this order at each of the plural positions of the pipe material while the coil unit is kept held by the support member.

In this electromagnetic forming method, since the insertion-side tip portion of the coil unit is held by the support member with high accuracy, the coil unit is not prone to be off-centered inside the pipe material even in the case where the coil unit is inserted into a long pipe material. As a result, a variation of electromagnetic formation on the pipe material is reduced and the pipe material can be joined to the pipe periphery members with uniform swaging states because the pipe material is fixed to the pipe periphery members satisfactorily. Furthermore, since the coil unit is fixed by the holding member so as not to move in the axial direction, the axial movement of the coil unit in electromagnetic formation can be reduced more easily than in the case where the axial movement is restricted only by the coil unit side.

(2) An electromagnetic forming method, including:

a step of setting pipe periphery members at plural positions along an axial direction of a pipe material;

a step of setting a pair of coil units on a side of one end and a side of the other end, in the axial direction, of the pipe material, each of the coil units including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a coil unit holding step of causing the pair of coil units to butt against each other by relatively moving the coil units to each other in the axial direction of the pipe material, thereby causing a tip portion of a support member to hold a tip portion of the coil unit which faces the support member coaxially, the support member being provided at an insertion-side tip of at least one of the coil units and at least two end portions of the support member in the axial direction being made of an insulator;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit set at an axial position of the pipe periphery member, in which the coil setting step and the swaging step are performed in this order at each of the plural positions of the pipe material while the coil unit is kept held by the support member.

In this electromagnetic forming method, since the insertion-side tip portion of one coil unit is held by the support member with high accuracy, the coil unit is not prone to be off-centered inside the pipe material even in the case where the coil unit is inserted into a long pipe material. As a result, a variation of electromagnetic formation on the pipe material is reduced and the pipe material can be joined to the pipe periphery members with uniform swaging states because the pipe material is fixed to the pipe periphery members satisfactorily. Furthermore, since the coil unit is fixed by the holding member so as not to move in the axial direction, the axial movement of the one coil unit in electromagnetic formation can be reduced more easily than in the case where the axial movement is restricted only by the coil unit side. Still further, electromagnetic formation can be performed at plural expansion positions at one time or successively since the pair of coil units is inserted into the pipe material. As a result, the production efficiency can be increased than in the case where the holding member is pulled out of the pipe material and the coil unit is newly inserted for each expansion position.

(3) The electromagnetic forming method according to (1) or (2), in which the coil unit in which the conductor wound portion is provided at plural positions in the axial direction is used.

In this electromagnetic forming method, since the conductor wound portion is provided at plural positions, electromagnetic formation can be performed at one time or successively at plural positions and hence the production efficiency is increased.

(4) The electromagnetic forming method according to any one of (1) to (3), in which in the coil unit holding step, an engagement portion provided at an insertion-side tip of the support member is engaged with an insertion-side tip portion of the coil unit, thereby holding the coil unit and the support member coaxially.

In this electromagnetic forming method, the coil unit and the support member are accurately positioned so as to be coaxial with each other by the engagement portion.

(5) The electromagnetic forming method according to (4), in which an outer circumferential surface of the pipe material is set parallel with facing surfaces of the pipe peripheral members which face the outer circumferential surface in a cross section taken along the axial direction of the pipe material and the pipe peripheral members that are set outside the outer circumferential surface of the pipe material.

In this electromagnetic forming method, when the pipe material is expanded and comes into contact with a pipe periphery member, the entire outer circumferential surface of the portion concerned of the pipe material at the same time. Thus, induction current induced in the pipe material does not escape to the pipe periphery member locally and electromagnetic expansion force is generated uniformly in the circumferential direction of the pipe material. This enables uniform plastic deformation of the pipe material.

(6) The electromagnetic forming method according to any one of (1) to (5), in which each of the pipe peripheral members includes a through-hole through which the pipe material to be inserted, and in which the pipe material is supported such that the pipe material is coaxial with the through-holes.

In this electromagnetic forming method, since the inner circumferential surface of each through-hole is parallel with the outer circumferential surface of the pipe material, the gap between the inner circumferential surface and the outer circumferential surface is constant and hence the entire outer circumferential surface of the pipe material comes into contact with the inner circumferential surface of the through-hole simultaneously when the pipe material is expanded.

The present application is based on Japanese Patent Application No. 2018-37758 filed on Mar. 2, 2018, the entire subject matter of which is incorporated herein by reference.

REFERENCE SIGNS LIST

13: Aluminum pipe material (pipe material)
15, 15A, 15B, 15C, 15D: Bracket (pipe periphery member)
17: Through-hole
27, 27A, 27B, 27C, 28: Coil unit
33: Support rod (support member)
45, 47: Pipe material positioning member
61, 61A, 61B, 62A, 62B: Coil portion
63: Conductor wound portion
65*a*, 65*b*: Conductor extension portion
67, 68A, 68B: Conductor support portion
75: Communication hole
77: Conductor
111, 125, 125A: Coil holding portion
113: Engagement recess (engagement portion)

The invention claimed is:

1. An electromagnetic forming method, comprising:

a step of setting pipe periphery members at plural positions along an axial direction of a pipe material;

a step of setting a coil unit on a side of one end, in the axial direction, of the pipe material, the coil unit including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a step of setting a support member on a side of the other end, in the axial direction, of the pipe material, wherein at least a tip of the support member on a side of the pipe material is made of an insulator;

a coil unit holding step of causing the coil unit and the support member to butt against each other by relatively moving the coil unit and the support member to each other in the axial direction of the pipe material, thereby causing the tip portion of the support member to hold the coil unit coaxially;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit, wherein the coil setting step and the swaging step are performed in this order at each of the plural positions of the pipe material while the coil unit is kept held by the support member.

2. The electromagnetic forming method according to claim 1, wherein the coil unit in which the conductor wound portion is provided at plural positions in the axial direction is used.

3. The electromagnetic forming method according to claim 2, wherein in the coil unit holding step, an engagement portion provided at an insertion-side tip of the support member is engaged with an insertion-side tip portion of the coil unit, thereby holding the coil unit and the support member coaxially.

4. The electromagnetic forming method according to claim 3, wherein each of the pipe peripheral members includes a through-hole through which the pipe material is to be inserted, wherein the pipe material is supported such that the pipe material is coaxial with the through-hole.

5. The electromagnetic forming method according to claim 2, wherein each of the pipe peripheral members includes a through-hole through which the pipe material is to be inserted, wherein the pipe material is supported such that the pipe material is coaxial with the through-hole.

6. The electromagnetic forming method according to claim 1, wherein in the coil unit holding step, an engagement portion provided at an insertion-side tip of the support member is engaged with an insertion-side tip portion of the coil unit, thereby holding the coil unit and the support member coaxially.

7. The electromagnetic forming method according to claim 6, wherein an outer circumferential surface of the pipe material is set parallel with facing surfaces of the pipe peripheral members which face the outer circumferential surface in a cross section taken along the axial direction of the pipe material and the pipe peripheral members that are set outside the outer circumferential surface of the pipe material.

8. The electromagnetic forming method according to claim 7, wherein each of the pipe peripheral members includes a through-hole through which the pipe material is to be inserted, wherein the pipe material is supported such that the pipe material is coaxial with the through-hole.

9. The electromagnetic forming method according to claim 6, wherein each of the pipe peripheral members includes a through-hole through which the pipe material is to be inserted, wherein the pipe material is supported such that the pipe material is coaxial with the through-hole.

10. The electromagnetic forming method according to claim 1, wherein each of the pipe peripheral members includes a through-hole through which the pipe material is to be inserted, wherein the pipe material is supported such that the pipe material is coaxial with the through-hole.

11. An electromagnetic forming method, comprising:

a step of setting pipe periphery members at plural positions along an axial direction of a pipe material;

a step of setting a pair of coil units on a side of one end and a side of the other end, in the axial direction, of the pipe material, each of the coil units including a conductor wound portion, conductor extension portions, one end portion of which is connected to the conductor wound portion and which extend in a longitudinal direction, and a resin-made conductor support portion that is provided along the longitudinal direction and that supports at least the conductor extension portions;

a coil unit holding step of causing the pair of coil units to butt against each other by relatively moving the coil units to each other in the axial direction of the pipe material, thereby causing a tip portion of a support member to hold a tip portion of the coil unit which faces the support member coaxially, the support member being provided at an insertion-side tip of at least one of the coil units and at least two end portions of the support member in the axial direction being made of an insulator;

a coil setting step of setting the conductor wound portion of the coil unit at a position inside the pipe material where the conductor wound portion overlaps with the pipe periphery member; and a swaging step of fixing the pipe periphery member to the pipe material by expanding the pipe material by electromagnetic force generated by energizing the conductor wound portion of the coil unit set at an axial position of the pipe periphery member, wherein the coil setting step and the swaging step are performed in this order at each of the plural positions of the pipe material while the coil unit is kept held by the support member.

12. The electromagnetic forming method according to claim 11, wherein the coil unit in which the conductor wound portion is provided at plural positions in the axial direction is used.

13. The electromagnetic forming method according to claim 12, wherein in the coil unit holding step, an engagement portion provided at an insertion-side tip of the support member is engaged with an insertion-side tip portion of the coil unit, thereby holding the coil unit and the support member coaxially.

14. The electromagnetic forming method according to claim 13, wherein each of the pipe peripheral members includes a through-hole through which the pipe material is to be inserted, wherein the pipe material is supported such that the pipe material is coaxial with the through-hole.

15. The electromagnetic forming method according to claim 12, wherein each of the pipe peripheral members includes a through-hole through which the pipe material is to be inserted, wherein the pipe material is supported such that the pipe material is coaxial with the through-hole.

16. The electromagnetic forming method according to claim 11, wherein in the coil unit holding step, an engagement portion provided at an insertion-side tip of the support member is engaged with an insertion-side tip portion of the coil unit, thereby holding the coil unit and the support member coaxially.

17. The electromagnetic forming method according to claim 16, wherein an outer circumferential surface of the pipe material is set parallel with facing surfaces of the pipe peripheral members which face the outer circumferential surface in a cross section taken along the axial direction of the pipe material and the pipe peripheral members that are set outside the outer circumferential surface of the pipe material.

18. The electromagnetic forming method according to claim 17, wherein each of the pipe peripheral members includes a through-hole through which the pipe material is to be inserted, wherein the pipe material is supported such that the pipe material is coaxial with the through-hole.

19. The electromagnetic forming method according to claim 16, wherein each of the pipe peripheral members includes a through-hole through which the pipe material is to be inserted, wherein the pipe material is supported such that the pipe material is coaxial with the through-hole.

20. The electromagnetic forming method according to claim 11, wherein each of the pipe peripheral members includes a through-hole through which the pipe material is to be inserted, wherein the pipe material is supported such that the pipe material is coaxial with the through-hole.

* * * * *